US012180573B2

(12) United States Patent
Fujinaka et al.

(10) Patent No.: US 12,180,573 B2
(45) Date of Patent: Dec. 31, 2024

(54) HOT-STAMPING FORMED BODY

(71) Applicant: NIPPON STEEL CORPORATION, Tokyo (JP)

(72) Inventors: Shingo Fujinaka, Tokyo (JP); Yuri Toda, Tokyo (JP); Daisuke Maeda, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 624 days.

(21) Appl. No.: 17/431,324

(22) PCT Filed: Mar. 19, 2020

(86) PCT No.: PCT/JP2020/012395
§ 371 (c)(1),
(2) Date: Aug. 16, 2021

(87) PCT Pub. No.: WO2020/189767
PCT Pub. Date: Sep. 24, 2020

(65) Prior Publication Data

US 2022/0119929 A1 Apr. 21, 2022

(30) Foreign Application Priority Data

Mar. 20, 2019 (JP) ..... 2019-052103

(51) Int. Cl.

| | |
|---|---|
| ***C22C 38/06*** | (2006.01) |
| ***B21D 22/02*** | (2006.01) |
| ***C22C 38/00*** | (2006.01) |
| ***C22C 38/02*** | (2006.01) |
| ***C22C 38/44*** | (2006.01) |

(Continued)

(52) U.S. Cl.
CPC ..... *C22C 38/58* (2013.01); *B21D 22/022* (2013.01); *C22C 38/002* (2013.01); *C22C 38/02* (2013.01); *C22C 38/06* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C21D 2211/001* (2013.01)

(58) Field of Classification Search
CPC ..... C22C 38/06
See application file for complete search history.

(56) References Cited

U.S. PATENT DOCUMENTS

| | | | |
|---|---|---|---|
| 2016/0145704 | A1 | 5/2016 | Kawasaki et al. |
| 2016/0273066 | A1 | 9/2016 | Sakakibara et al. |

(Continued)

FOREIGN PATENT DOCUMENTS

| | | |
|---|---|---|
| EP | 3 124 637 A1 | 2/2017 |
| JP | 5030280 B2 | 9/2012 |

(Continued)

*Primary Examiner* — Jophy S. Koshy
(74) *Attorney, Agent, or Firm* — Birch, Stewart, Kolasch & Birch, LLP

(57) ABSTRACT

A hot-stamping formed body has a predetermined chemical composition, in which an average grain size of prior austenite grains in a microstructure is 5.0 μm or less, and an average Mn concentration at grain boundaries of the prior austenite grains is 1.0 mass % or less. The hot-stamping formed body may be provided with a plating layer on the surface thereof, or may have a softened region in a portion thereof.

8 Claims, 3 Drawing Sheets

(51) Int. Cl.

| | |
|---|---|
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| ***C22C 38/58*** | (2006.01) |

(56) References Cited

U.S. PATENT DOCUMENTS

| | | | | |
|---|---|---|---|---|
| 2017/0096724 | A1* | 4/2017 | Hikida | C22C 38/00 |
| 2017/0283892 | A1 | 10/2017 | Garcia | |
| 2019/0330711 | A1 | 10/2019 | Abukawa et al. | |

FOREIGN PATENT DOCUMENTS

| | | | | |
|---|---|---|---|---|
| JP | 5402191 | B2 | 1/2014 | |
| JP | 2017-043825 | A | 3/2017 | |
| JP | 6132017 | B2 | 5/2017 | |
| JP | 6187729 | B1 | 8/2017 | |
| JP | 6460287 | B1 | 1/2019 | |
| KR | 101280719 | B1 | 7/2013 | |
| KR | 10-2017-0078614 | A | 7/2017 | |
| WO | WO 2015/041159 | A1 | 3/2015 | |
| WO | WO-2015147216 | A1 * | 10/2015 | B22D 11/001 |
| WO | WO 2018/134874 | A1 | 7/2018 | |
| WO | WO 2019/186928 | A1 | 10/2019 | |

* cited by examiner

HOT-STAMPING FORMED BODY

TECHNICAL FIELD OF THE INVENTION

The present invention relates to a hot-stamping formed body.

Priority is claimed on Japanese Patent Application No. 2019-052103, filed Mar. 20, 2019, the content of which is incorporated herein by reference.

BACKGROUND ART

In recent years, there has been a demand for a reduction in the weight of vehicle body of a vehicle from the viewpoint of environmental protection and resource saving, and a high strength steel sheet has been increasingly applied to a member for a vehicle. The higher the strength of the steel sheet, the greater the load during press forming on the member for a vehicle. In addition, when a high strength steel sheet is used, formability into a member having a complex shape becomes a problem. In order to solve such a problem, a hot stamping technique in which press forming is performed after heating to the austenite region where the steel sheet softens has been applied.

Hot stamping has attracted attention as a technique that achieves both forming into a member for a vehicle and securing strength by performing a hardening treatment in a die simultaneously with press working. Hot stamping has been employed as a working method for a deformation suppressing member and an impact absorbing member of a vehicle. In particular, the deformation suppressing member is required to be a member that is hardly deformed by a collision, and is required to be subjected to high-strengthening.

However, in general, the toughness decreases as the strength of the steel sheet increases, so that cracks are likely to occur during the collision deformation. As a result, there are cases where the proof stress and absorbed energy required for the member for a vehicle cannot be obtained.

Patent Document 1 proposes a technique in which spheroidizing annealing at 650 to $Ac_1$+20° C. before hardening and tempering to spheroidize carbides and undissolved carbides are reduced in amount during hardening and tempering heat treatments, thereby improving toughness.

Patent Document 2 proposes a hot-rolled steel sheet in which the total amount of tempered martensite and lower bainite is set to 90% or more to provide a homogeneous microstructure, thereby achieving both high strength and low temperature toughness.

Patent Document 3 proposes an ultrahigh-strength cold-rolled steel sheet having a tempered martensite single phase as its microstructure and improved stretch flangeability.

Patent Document 4 proposes a method of manufacturing a formed body capable of achieving both high strength and toughness by hardening performed twice. In this manufacturing method, the microstructure of steel is formed into martensite containing a large amount of fine carbides by a first hardening heat treatment (it is described that the number density of the carbides is preferably 0.50/$\mu m^2$ or more). Thereafter, rapid heating is performed in a second hardening heat treatment to cause the carbides to act as nucleation sites for reverse transformation to austenite, thereby achieving the refinement of the microstructure.

PRIOR ART DOCUMENT

Patent Document

[Patent Document 1] Japanese Patent No. 5030280
[Patent Document 2] Japanese Patent No. 6132017

[Patent Document 3] Japanese Patent No. 5402191
[Patent Document 4] PCT International Publication No. WO2018/134874

DISCLOSURE OF THE INVENTION

Problems to be Solved by the Invention

In the technique described in Patent Document 1, annealing is performed by heating at lower than the $Ac_3$ point for the purpose of spheroidizing carbides. Therefore, Mn is not sufficiently diffused, and a portion having a high Mn concentration is present in the annealed steel, and the toughness of the steel deteriorates. In addition, coarse carbides are generated in the microstructure of the steel due to the spheroidizing annealing. Since such carbides are likely to be a fracture origin in a high strength steel of 2,000 MPa or more, there are cases where the toughness of the steel significantly deteriorates.

In the technique described in Patent Document 2, although the microstructure is uniform as a whole, there are cases where Mn is segregated in prior austenite grains. When the degree of segregation of Mn is reduced, the portion having a high Mn concentration does not become the fracture origin, and a further improvement in toughness can be expected. However, in Patent Document 2, the method has not been clarified.

In the technique described in Patent Document 3, although annealing is performed at 900° C. or lower in order not to coarsen the prior austenite grains, Mn is not sufficiently diffused, and there are cases where Mn is segregated in the microstructure. As described above, the portion having a locally high Mn concentration tends to be a fracture origin in a high strength steel of 2,000 MPa or more, so that there are cases where the toughness of the steel deteriorates. In addition, in this technique, it is necessary to perform tempering at 250° C. after the microstructure is formed into martensite, which causes an increase in manufacturing cost due to an increase in the number of processes.

In the technique described in Patent Document 4, the steel in which carbides are generated as much as possible during the first heat treatment is subjected to the second heat treatment for reverse transformation to austenite using the carbides as the nucleation site. Therefore, the amount of residual austenite is small during the first heat treatment and the grain growth of austenite is likely to proceed during the second heat treatment. Therefore, a method of further refining grains is required.

The present invention has been made to solve the problems of the related art, and an object thereof is to provide a hot-stamping formed body having excellent strength and toughness.

Means for Solving the Problem

As a result of intensive examinations on a method for solving the above problems, the present inventors have obtained the following findings.

In the related art, in order to secure a tensile strength of 2,000 MPa or more, it is necessary to secure hardenability, and it has been considered that it is effective to contain Mn. However, the containing of Mn promotes Mn segregation at the grain boundaries, resulting in inferior toughness of the hot-stamping formed body. Therefore, as a result of intensive studies, the present inventors found that a hot-stamping formed body having better toughness than in the related art can be obtained even with a material containing Mn.

The present inventors found that, as a microstructure of a hot-stamping formed body, the occurrence of a crack can be suppressed by controlling the average grain size of prior austenite grains to 5.0 μm or less, and setting the average Mn concentration at the grain boundaries of the prior austenite grains (hereinafter, sometimes described as prior austenite grain boundaries) to 1.0 mass % or less. In addition, as a result of intensive examinations by the present inventors, it was found that the above-mentioned microstructure can be obtained by the following method.

First, a pre-heat treatment (hereinafter, referred to as "first heat treatment") is performed before a hot stamping step. The first heat treatment is a heat treatment including a heating step of heating to a heating temperature T1 of an $Ac_3$ point to the $Ac_3$ point+200° C., a holding step of holding at the heating temperature T1, and a cooling step of cooling from the heating temperature T1 to a cooling stop temperature of "250° C. to 400° C." at an average cooling rate of 10° C./s to 500° C./s. The heating step and the holding step of the first heat treatment have a role of re-dissolving coarse carbides formed before the first heat treatment and a role of concentrating Mn at the prior austenite grain boundaries. In addition, since the microstructure is controlled to include martensite, tempered martensite, bainite, and tempered bainite by the cooling step of the first heat treatment, a large amount of high angle grain boundaries are formed in the prior austenite grains.

Next, a thermo-mechanical treatment (hereinafter, referred to as "second heat treatment") of a hot stamping step is performed. The second heat treatment is a heat treatment including a heating step of performing rapid heating to a heating temperature T2 of an $Ac_3'$ point to ($Ac_3'$ point+100° C.) at an average heating rate of 10° C./s to 500° C./s, and a holding step of holding at the heating temperature T2 for longer than 10 seconds and 60 seconds or shorter. Here, the difference (T2−cooling stop temperature) between the cooling stop temperature during the first heat treatment and the heating temperature T2 during the second heat treatment is lower than 600° C.

The steel after the holding step of the second heat treatment is subjected to hot stamping and cooling.

The $Ac_3'$ point is a temperature obtained by an experiment. Details thereof will be described later.

In the heating step of the second heat treatment, diffusion of Mn from the prior austenite grain boundaries to the high angle grain boundaries formed in the first heat treatment occurs. Accordingly, Mn is concentrated in fine residual austenite present at the high angle grain boundaries (between blocks). As Mn is concentrated in the residual austenite, the stability of the residual austenite increases, and the $Ac_3$ point decreases. The decreased $Ac_3$ point is referred to as "$Ac_3'$ point" for convenience.

In a temperature range exceeding the $Ac_3'$ point, austenitizing proceeds. Here, since austenitizing at this stage proceeds at a low temperature, the grain growth of austenite is suppressed. In addition, since fine austenite is maintained, Mn concentration from the prior austenite grain boundaries to the high angle grain boundaries continues.

The steel after the second heat treatment is subjected to hot stamping and cooled to room temperature. Accordingly, a hot-stamping formed body is obtained. By these steps, a fine grain structure in which the average grain size of the prior austenite grains of the hot-stamping formed body is 5.0 μm or less can be achieved, and the average Mn concentration at the grain boundaries of the prior austenite grains can be reduced to 1.0 mass % or less. As a result, fracture (the occurrence of a crack) at the time of a collision is suppressed due to a reduction in a high Mn concentration region of the prior austenite grain boundaries, and the propagation of a crack is suppressed due to fine prior austenite grain sizes. As a result, it becomes possible to obtain a hot-stamping formed body having excellent toughness.

The gist of the present invention made based on the above findings is as follows.

[1] A hot-stamping formed body according to an aspect of the present invention includes, as a chemical composition, by mass %:

C: 0.40% to 0.70%;
Si: 0.010% to 1.30%;
Mn: 0.40% to 3.00%;
sol. Al: 0.0010% to 0.500%;
Ti: 0.010% to 0.100%;
Cr: 0.010% to 0.80%;
B: 0.0005% to 0.0100%;
P: 0.100% or less;
S: 0.0100% or less;
N: 0.0100% or less;
Nb: 0% to 0.100%;
Mo: 0% to 1.00%;
V: 0% to 0.100%;
Ni: 0% to 0.50%;
REM: 0% to 0.0100%;
Mg: 0% to 0.0100%;
Ca: 0% to 0.0100%;
Co: 0% to 4.00%; and
a remainder consisting of Fe and impurities,
in which an average grain size of prior austenite grains in a microstructure is 5.0 μm or less, and
an average Mn concentration at grain boundaries of the prior austenite grains is 1.0 mass % or less.

[2] The hot-stamping formed body according to [1] may include, as the chemical composition, by mass %, one or two or more elements selected from:

Nb: 0.010% to 0.100%;
Mo: 0.01% to 1.00%;
V: 0.001% to 0.100%;
Ni: 0.001% to 0.50%;
REM: 0.0010% to 0.0100%;
Mg: 0.0010% to 0.0100%;
Ca: 0.0010% to 0.0100%; and
Co: 0.10% to 4.00%.

[3] The hot-stamping formed body according to [1] or [2] may further include: a plating layer on a surface of the hot-stamping formed body.

[4] In the hot-stamping formed body according to any one of [1] to [3], a portion of the hot-stamping formed body may have a softened region.

Effects of the Invention

According to the present invention, it is possible to provide a hot-stamping formed body having excellent strength and toughness.

EMBODIMENTS OF THE INVENTION

Figure 1:
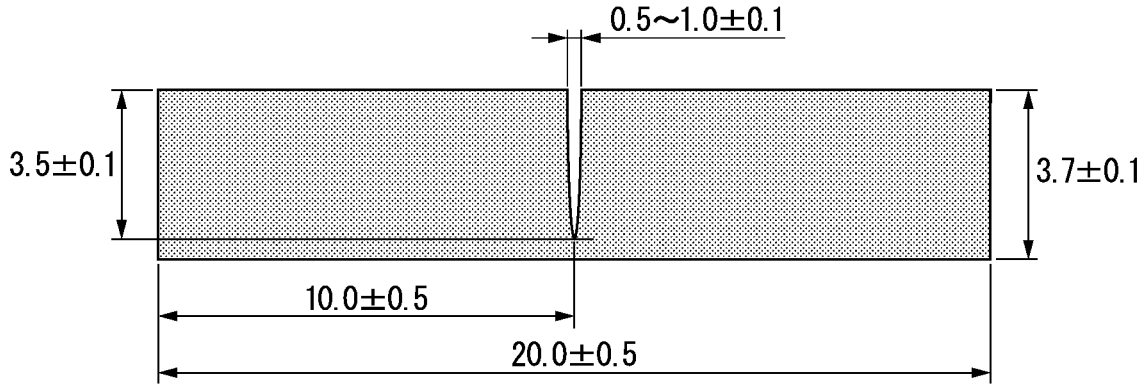
FIG. 1 is a diagram showing the shape of a test piece used for measuring the average Mn concentration at the grain boundaries of prior austenite grains.

Hereinafter, a hot-stamping formed body according to the present embodiment and a method of manufacturing the same will be described in detail. However, the present invention is not limited to the configuration disclosed in the present embodiment, and various modifications can be made without departing from the gist of the present invention.

<Chemical Composition of Hot-Stamping Formed Body>

First, the reason for limiting the chemical composition of the hot-stamping formed body according to the present embodiment will be described. Hereinafter, all % regarding the chemical composition means mass %. Numerical values indicated as "more than or equal to" or "less than or equal to" fall within the numerical range. Numerical values indicated as "less than" or "more than" do not fall within the numerical range.

The hot-stamping formed body according to the present embodiment includes, as a chemical composition, by mass %: C: 0.40% to 0.70%; Si: 0.010% to 1.30%; Mn: 0.40% to 3.00%; sol. Al: 0.0010% to 0.500%; Ti: 0.010% to 0.100%; Cr: 0.010% to 0.80%; B: 0.0005% to 0.0100%; P: 0.100% or less; S: 0.0100% or less; N: 0.0100% or less; and a remainder consisting of Fe and impurities. Hereinafter, each element will be described in detail.

"C: 0.40% to 0.70%"

C is an important element for obtaining a tensile strength of 2,000 MPa or more in the hot-stamping formed body. When the C content is less than 0.40%, martensite becomes soft and it is difficult to obtain a tensile strength of 2,000 MPa or more. Therefore, the C content is set to 0.40% or more. The C content is preferably 0.43% or more, and 0.45% or more. On the other hand, when the C content exceeds 0.70%, coarse carbides are generated and fracture is likely to occur, resulting in a decrease in the toughness of the hot-stamping formed body. For this reason, the C content is set to 0.70% or less. The C content is preferably 0.60% or less, and 0.55% or less.

"Si: 0.010% to 1.30%"

Si has an effect of suppressing the formation of coarse cementite, and is an important element for securing the toughness of the hot-stamping formed body. In addition, Si has resistance to temper softening, and has an action of suppressing a decrease in strength due to self-tempering during hot stamping hardening. When the Si content is less than 0.010%, the above effect cannot be obtained, and there are cases where the toughness of the hot-stamping formed body deteriorates. Therefore, the Si content is set to 0.010% or more. The Si content is preferably 0.02% or more, and 0.03% or more. On the other hand, in a case where Si is contained in an amount of more than 1.30%, the stability of austenite decreases, and the diffusion of Mn to high angle grain boundaries does not proceed sufficiently during a second heat treatment, so that the toughness of the hot-stamping formed body deteriorates. Therefore, the Si content is set to 1.30% or less. The Si content is preferably 1.20% or less, and 1.00% or less.

"Mn: 0.40% to 3.00%"

Mn is an element that contributes to an improvement in the strength of the hot-stamping formed body by solid solution strengthening. When the Mn content is less than 0.40%, the solid solution strengthening ability is poor and martensite becomes soft, so that it is difficult to obtain a tensile strength of 2,000 MPa or more in the hot-stamping formed body. Therefore, the Mn content is set to 0.40% or more. The Mn content is more preferably 0.50% or more, and 0.60% or more. On the other hand, when the Mn content exceeds 3.00%, coarse inclusions are generated in the steel and fracture is likely to occur, resulting in a decrease in the toughness of the hot-stamping formed body. Therefore, the Mn content is set to 3.00% or less. The Mn content is preferably 2.50% or less, 2.00% or less, and 1.50% or less.

"Sol. Al: 0.0010% to 0.500%"

Al is an element having an action of deoxidizing molten steel and achieving soundness of the steel (suppressing the occurrence of defects such as blowholes in the steel). When the sol. Al content is less than 0.0010%, deoxidation does not sufficiently proceed. Therefore, the sol. Al content is set to 0.0010% or more. The sol. Al content is preferably 0.010% or more, and 0.020% or more. On the other hand, when the sol. Al content exceeds 0.500%, coarse oxides are generated in the steel, and the toughness of the hot-stamping formed body decreases. Therefore, the sol. Al content is set to 0.500% or less. The sol. Al content is preferably 0.400% or less, and 0.350% or less.

In addition, sol. Al means acid-soluble Al, and indicates solute Al present in the steel in a solid solution state.

"Ti: 0.010% to 0.100%"

Ti is an element that forms carbonitrides and suppresses the grain growth of austenite during hot-stamping heating (particularly during a second heat treatment). When the Ti content is less than 0.010%, the above effect cannot be obtained, and prior austenite grains become coarse, so that the toughness of the hot-stamping formed body deteriorates. Therefore, the Ti content is set to 0.010% or more. The Ti content is preferably 0.020% or more, and 0.025% or more. On the other hand, when Ti is contained in an amount of more than 0.100%, coarse TiN is generated, so that the toughness of the hot-stamping formed body deteriorates. Therefore, the Ti content is set to 0.100% or less. The Ti content is preferably 0.080% or less, or 0.060% or less.

"Cr: 0.010% to 0.80%"

Cr is an element forming carbides and is also an element that improves the toughness of the hot-stamping formed body by refining the carbides. When the Cr content is less than 0.010%, the above effect cannot be obtained. Therefore, the Cr content is set to 0.010% or more. The Cr content is preferably 0.10% or more, and 0.15% or more. On the other hand, even if Cr is contained in an amount of more than 0.80%, the above effect is saturated. In addition, Cr fills Mg segregation sites of prior austenite grain boundaries and inhibits the segregation of Mn to the prior austenite grain boundaries during a first heat treatment. As a result, the amount of Mn in the prior austenite grains increases, and there are cases where the toughness of the hot-stamping formed body deteriorates. Therefore, the Cr content is set to 0.80% or less. The Cr content is preferably 0.60% or less, 0.50% or less, and 0.40% or less.

"B: 0.0005% to 0.0100%"

B is an element that segregates to grain boundaries and enhances the hardenability of the steel. When the B content is less than 0.0005%, the above effect cannot be obtained, and there are cases where ferrite is formed. As a result, there are cases where it is difficult to obtain a tensile strength of 2,000 MPa or more, and the toughness of the hot-stamping formed body deteriorates. Therefore, the B content is set to 0.0005% or more. The B content is preferably 0.0010% or more, 0.0015% or more, and 0.0020% or more. On the other hand, since B is likely to segregate to the prior austenite grain boundaries, when B is contained in an amount of more than 0.0100%, B inhibits the segregation of Mn to the prior austenite grain boundaries during the first heat treatment. As a result, the amount of Mn in the prior austenite grains increases, and there are cases where the toughness of the hot-stamping formed body deteriorates. Therefore, the B content is set to 0.0100% or less. The B content is preferably 0.0075% or less, and 0.0050% or less.

"P: 0.100% or Less"

P is an element that segregates to the grain boundaries and reduces intergranular strength. When the P content exceeds 0.100%, the intergranular strength significantly decreases, and the toughness of the hot-stamping formed body decreases. Therefore, the P content is set to 0.100% or less. The P content is preferably 0.050% or less, and 0.030% or less. The lower limit of the P content is not particularly limited. However, when the P content is reduced to less than 0.0001%, the dephosphorization cost is increased significantly, which is economically unfavorable. In an actual operation, the P content may be set to 0.0001% or more.

"S: 0.0100% or Less"

S is an element that forms inclusions in the steel. When the S content exceeds 0.0100%, a large amount of inclusions are generated in the steel, and the toughness of the hot-stamping formed body decreases. Therefore, the S content is set to 0.0100% or less. The S content is preferably 0.0040% or less. The lower limit of the S content is not particularly limited. However, when the S content is reduced to less than 0.00015%, the desulfurization cost is increased significantly, which is economically unfavorable. In an actual operation, the S content may be set to 0.00015% or more, and 0.0002% or more.

"N: 0.0100% or Less"

N is an impurity element that forms nitrides in the steel and is an element that deteriorates the toughness of the hot-stamping formed body. When the N content exceeds 0.0100%, coarse nitrides are generated in the steel, and the toughness of the hot-stamping formed body significantly decreases. Therefore, the N content is set to 0.0100% or less. The N content is preferably 0.0075% or less, and 0.0050% or less. The lower limit of the N content is not particularly limited. However, when the N content is reduced to less than 0.0001%, the denitrification cost is increased significantly, which is economically unfavorable. In an actual operation, the N content may be set to 0.0001% or more.

The remainder of the chemical composition of the hot-stamping formed body according to the present embodiment consists of Fe and impurities. The impurities are elements unavoidably incorporated from steel raw materials or scrap, elements unavoidably incorporated in a steelmaking process, and/or elements intentionally added in a small amount, and examples thereof are elements that are allowed in a range in which the characteristics of the hot-stamping formed body according to the present embodiment are not inhibited.

In the hot-stamping formed body according to the present embodiment, the following optional elements may be contained instead of a portion of Fe. The lower limit of the amounts of the optional elements in a case where the following optional elements are not contained is 0%. Hereinafter, each optional element will be described in detail.

"Nb: 0% to 0.100%"

Nb is an element that improves the strength of the hot-stamping formed body by solid solution strengthening and forms carbonitrides, thereby contributing to grain refinement of the prior austenite grains. Therefore, Nb may be contained as necessary. In a case where Nb is contained, the Nb content is preferably set to 0.010% or more in order to reliably exhibit the above effect. The Nb content is more preferably 0.035% or more. On the other hand, when Nb is contained in an amount of more than 0.100%, carbonitrides are excessively generated, and there are cases where the toughness of the hot-stamping formed body decreases. Therefore, the Nb content is preferably set to 0.100% or less. The Nb content is more preferably 0.080% or less.

"Mo: 0% to 1.00%"

Mo is an element that improves the strength of the hot-stamping formed body by solid solution strengthening and increase the hardenability of the steel, thereby suppressing the formation of ferrite that deteriorates the toughness. Therefore, Mo may be contained are necessary. In a case where Mo is contained, the Mo content is preferably set to 0.01% or more in order to reliably exhibit the above effect. The Mo content is more preferably 0.02% or more. On the other hand, even if Mo is contained in an amount of more than 1.00%, not only is the above effect saturated, but also an increase in the alloy cost is incurred. Therefore, the Mo content is preferably set to 1.00% or less. The Mo content is more preferably 0.80% or less.

"V: 0% to 0.100%"

V is an element that improves the strength of the hot-stamping formed body by solid solution strengthening. In order to reliably obtain the effect, the V content is preferably set to 0.001% or more. The V content is more preferably 0.050% or more. On the other hand, when the V content exceeds 0.100%, carbonitrides are excessively generated, and the toughness of the hot-stamping formed body decreases. Therefore, the V content is preferably set to 0.100% or less. The V content is more preferably 0.090% or less.

"Ni: 0% to 0.50%"

Ni is an element that dissolves in austenite as a solid solution, has an action of enhancing the hardenability of the steel, and improves the toughness of the hot-stamping formed body. In order to reliably obtain the above effect, the Ni content is preferably set to 0.001% or more. The Ni content is more preferably 0.01% or more. On the other hand, even if Ni is contained in an amount of more than 0.50%, the above effect is saturated, and an increase in the alloy cost is incurred. Therefore, the Ni content is preferably set to 0.50% or less. The Ni content is more preferably 0.40% or less.

"REM: 0% to 0.0100%"

REM is an element that has an action of deoxidizing molten steel and achieving soundness of the steel, and is also an element that improves the toughness of the hot-stamping formed body. Therefore, REM may be contained as necessary. In order to reliably obtain the above effect, the REM content is preferably set to 0.0010% or more. The REM content is more preferably 0.0020% or more. On the other hand, even if REM is contained in an amount of more than 0.0100%, the above effect is saturated, and an increase in the cost is incurred. Therefore, the REM content is preferably set to 0.0100% or less. The REM content is more preferably 0.0080% or less.

In the present embodiment, REM refers to a total of 17 elements including Sc, Y, and lanthanoids. In the present embodiment, the REM content refers to the total amount of these elements. Lanthanoids are added in the form of mischmetal in industry.

"Mg: 0% to 0.0100%"

Mg is an element having an action of deoxidizing molten steel and achieving soundness of the steel, and improves the toughness of the hot-stamping formed body. Therefore, Mg may be contained as necessary. In order to reliably obtain the above effect, the Mg content is preferably set to 0.0010% or more. The Mg content is more preferably 0.0020% or more. On the other hand, even if Mg is contained in an amount of more than 0.0100%, the above effect is saturated, and an increase in the cost is incurred. Therefore, the Mg content is preferably set to 0.0100% or less. The Mg content is more preferably 0.0080% or less.

"Ca: 0% to 0.0100%"

Ca is an element having an action of deoxidizing molten steel and achieving soundness of the steel, and improves the toughness of the hot-stamping formed body. Therefore, Ca may be contained as necessary. In order to reliably obtain the above effect, the Ca content is preferably set to 0.0010% or more. The Ca content is more preferably 0.0020% or more. On the other hand, even if Ca is contained in an amount of more than 0.0100%, the above effect is saturated, and an increase in the cost is incurred. Therefore, the Ca content is preferably set to 0.0100% or less. The Ca content is more preferably 0.0080% or less.

"Co: 0% to 4.00%"

Co is an element having an action of raising a martensite start temperature (Ms point) and improves the toughness of the hot-stamping formed body. Therefore, Co may be contained as necessary. In a case where Co is contained, the Co content is preferably set to 0.10% or more in order to reliably exhibit the above effect. The Co content is more preferably 0.20% or more. On the other hand, when the Co content exceeds 4.00%, the hardenability of the steel decreases, and it becomes difficult to obtain a tensile strength of 2,000 MPa or more. Therefore, the Co content is preferably set to 4.00% or less. The Co content is more preferably 3.00% or less.

The chemical composition of the hot-stamping formed body described above may be measured by a general analytical method. For example, the chemical composition may be measured using inductively coupled plasma-atomic emission spectrometry (ICP-AES). In addition, sol. Al may be measured by ICP-AES using a filtrate obtained by heating and decomposing a sample with an acid. C and S may be measured using a combustion-infrared absorption method, and N may be measured using an inert gas fusion-thermal conductivity method.

<Microstructure of Hot-Stamping Formed Body>

Next, the microstructure of the hot-stamping formed body according to the present embodiment will be described. In the present embodiment, the microstructure of the hot-stamping formed body means a microstructure in a region from a t/8 thickness depth from the surface to a 3t/8 thickness depth from the surface centered on a t/4 thickness position (t is the sheet thickness) from the surface.

In the hot-stamping formed body according to the present embodiment, the average grain size of the prior austenite grains in the microstructure is 5.0 μm or less, and the average Mn concentration at the grain boundaries of the prior austenite grains is 1.0 mass % or less. Hereinafter, each regulation will be described.

"Average Grain Size of Prior Austenite Grains Is 5.0 μm or Less, and Average Mn Concentration at Grain Boundaries of Prior Austenite Grains Is 1.0 mass % or Less."

In order to obtain excellent toughness in a hot-stamping formed body, it is preferable that the microstructure is finer. The present inventors found that in a high strength hot-stamping formed body having a tensile strength of more than 2,000 MPa, the toughness deteriorates when the average grain size of the prior austenite grains exceeds 5.0 μm. Therefore, the average grain size of the prior austenite grains is set to 5.0 μm or less. The average grain size of the prior austenite grains is more preferably 4.5 μm or less, 4.0 μm or less, and 3.5 μm or less.

The average grain size of the prior austenite grains may be set to 1.0 μm or more or 2.0 μm or more.

In addition, the present inventors also found that in order to obtain excellent toughness in a hot-stamping formed body, it is important to reduce the Mn concentration at the grain boundaries of the prior austenite grains (prior austenite grain boundaries). When a large amount of Mn is unevenly distributed at the prior austenite grain boundaries, the ductile fracture limit is significantly deteriorated, and Mn becomes a fracture origin at the time of a collision. As a result, the toughness of the hot-stamping formed body deteriorates. When the average Mn concentration at the prior austenite grain boundaries exceeds 1.0 mass %, the sensitivity to fracture is increased and the toughness of the hot-stamping formed body significantly deteriorates. Therefore, the average Mn concentration at the prior austenite grain boundaries is set to 1.0 mass % or less. The average Mn concentration at the prior austenite grain boundaries is preferably 0.8 mass % or less, 0.6 mass % or less, and 0.5 mass % or less.

The average Mn concentration at the prior austenite grain boundaries may be set to 0.1 mass % or more, or 0.2 mass % or more.

(Method of Measuring Average Grain Size of Prior Austenite Grains)

The average grain size of the prior austenite grains is measured by the following method.

First, the hot-stamping formed body is subjected to a heat treatment at 540° C. for 24 hours. This promotes corrosion of the prior austenite grain boundaries. As the heat treatment, furnace heating or energization heating may be performed, the temperature rising rate is set to 0.1 to 100° C./s, and the cooling rate is set to 0.1 to 150° C./s. A sheet thickness cross section perpendicular to the sheet surface is cut out from a center portion (a portion avoiding end portions) of the hot-stamping formed body after the heat treatment. This sheet thickness cross section is polished using #600 to #1500 silicon carbide paper and thereafter mirror-finished using a liquid obtained by dispersing a diamond powder having a particle size of 1 to 6 μm in a diluted solution such as alcohol or pure water. This sheet thickness cross section is used as an observed section.

Next, the observed section is immersed in a 3% to 4% sulfuric acid-alcohol (or water) solution (% is volume %) for 1 minute to reveal the prior austenite grain boundaries. The immersion work is performed in an exhaust treatment apparatus, and the temperature of the work atmosphere is room temperature (10° C. to 30° C., the same applies hereinafter). The observed section that reveals the prior austenite grain boundaries is washed with acetone or ethyl alcohol and dried. Thereafter, the observed section is observed with a scanning electron microscope. The scanning electron microscope used is equipped with a secondary electron detector.

In a vacuum of $9.6\times10^{-5}$ Pa or less, a sample is irradiated with an electron beam at an acceleration voltage of 15 kV and an irradiation current level of 13, and a secondary electron image of a region from a t/8 thickness depth from the surface to a 3t/8 thickness depth from the surface of the hot-stamping formed body is photographed. The photographing magnification is set to 4,000-fold based on a screen of 386 mm in width×290 mm in length, and the number of photographed visual fields is set to 10 or more visual fields.

In the photographed secondary electron image, the prior austenite grain boundaries are imaged as a bright contrast. The shortest diameter and the longest diameter of each of the prior austenite grains included in the photographed visual field are measured, and the average value thereof is calculated, thereby obtaining the grain size of the observed prior austenite grains. In a case where the entirety of a prior austenite grain is not included in the photographed visual field, such as in a case of an end portion of the photographed visual field, the grain size of the prior austenite grain is not measured. The grain sizes of all the prior austenite grains in all the photographed visual fields are calculated, and the average value thereof is calculated, thereby obtaining the average grain size of the prior austenite grains. The average grain size of the prior austenite grains is a value obtained by dividing the sum of the calculated grain sizes of the prior austenite grains by the total number of prior austenite grains whose grain sizes have been measured.

(Method of Measuring Average Mn Concentration at Grain Boundaries of Prior Austenite Grains)

A method of measuring the average Mn concentration at the grain boundaries of the prior austenite grains will be described.

A test piece having the dimensions shown in FIG. 1 is produced from the center portion (a portion avoiding the end portion) of the hot-stamping formed body. The front and rear surfaces of the test piece are removed by mechanical grinding in equal amounts so that the sheet thickness (the test piece length in a direction perpendicular to FIG. 1) becomes 1.2 mm. A notch is provided in the center portion of the test piece in the length direction (left-right direction in FIG. 1). This notch is formed by inserting a wire cutter having a thickness of 1 mm. In the width direction of the test piece (up-down direction in FIG. 1), the distance between the bottom of the notch and a side surface where the notch is not provided is controlled to 100 to 200 μm.

Next, the test piece is immersed in a 20%-ammonium thiocyanate solution (% is volume %) for 24 to 48 hours. The front and rear surfaces of the test piece are galvanized within 0.5 hours after the immersion is completed. After the galvanizing, the test piece is subjected to Auger electron emission spectroscopy within 1.5 hours. The kind of apparatus for performing the Auger electron emission spectroscopy is not particularly limited. The test piece is set in an analyzer, and in a vacuum of $9.6\times10^{-5}$ Pa or less, and the test piece is fractured from the notch portion to expose the prior austenite grain boundaries. The exposed prior austenite grain boundaries are irradiated with an electron beam at an acceleration voltage of 1 to 30 kV, and the Mn concentration (mass %) at the prior austenite grain boundaries is measured. The measurement is performed for three or more prior austenite grains at 10 or more positions at each prior austenite grain boundary. The measurement is completed within 30 minutes after the fracture to prevent contamination of the prior austenite grain boundaries. By calculating the average value of the obtained Mn concentrations (mass %), the average Mn concentration at the prior austenite grain boundaries is obtained.

The microstructure of the hot-stamping formed body is not particularly limited, but may include martensite (including fresh martensite and tempered martensite), upper bainite, lower bainite, residual austenite, and iron carbides and/or alloy carbides.

Preferably, the microstructure has martensite (including fresh martensite and tempered martensite) as the primary phase (90% or more in area ratio) and the remainder in the microstructure (upper bainite, lower bainite, residual austenite, and iron carbides and/or alloy carbides) in an area ratio of 10% or less. The area ratio of martensite is more preferably 95% or more, and even more preferably 100%. The area ratio of the remainder in the microstructure is more preferably 5% or less, and even more preferably 0%, in relation to the area ratio of martensite.

(Method of Measuring Area Ratio of Martensite)

The area ratio of martensite is measured by the following method.

A sample is taken from a position 50 mm or more away from the end surface of the hot-stamping formed body (or a position avoiding the end portion) so that the sheet thickness cross section can be observed. After polishing the observed section, nital etching is performed to clarify the contrast between carbides and grain boundaries. Next, using a field-emission scanning electron microscope (FE-SEM) equipped with a secondary electron detector, a secondary electron image of a region centered on a t/4 thickness position of the sample (a region from a ⅛ thickness depth from the surface to a ⅜ thickness depth from the surface) is photographed at a photographing magnification of 5,000-fold.

In the photograph obtained by the above method, phases other than martensite (ferrite, pearlite, upper bainite, lower bainite, residual austenite, and the like) and martensite (fresh martensite and tempered martensite) are distinguished from each other. Upper bainite, lower bainite, and tempered martensite can be distinguished by the presence or absence of iron carbides in the lath-like grains and the stretching direction of the iron carbides. Fresh martensite is not sufficiently etched by nital etching and is therefore distinguishable from other etched structures. However, since residual austenite is not sufficiently etched like martensite, the area ratio of fresh martensite is obtained by obtaining the difference from the area ratio of residual austenite obtained by a method described later.

Upper bainite is a phase formed of aggregates of lath-like grains, and is accompanied by precipitation of carbides between laths.

Lower bainite and tempered martensite are also phases formed of aggregates of lath-like grains, but are phases containing carbides inside the laths. Lower bainite and tempered martensite are distinguished from each other by the stretching direction of carbides. The carbides of lower bainite have a single variant, have an angular difference of 5° or less between carbides present in a single grain, and thus have substantially a single direction. On the other hand, the carbides of tempered martensite have a plurality of variants, and the carbides present in a single grain are stretched in a plurality of directions. By the difference, lower bainite and tempered martensite are distinguished from each other.

The area ratio of residual austenite is measured in the same region as the observed region from which the photograph is obtained. The observed section is polished using #600 to #1500 silicon carbide paper and thereafter mirror-finished using a liquid obtained by dispersing a diamond powder having a particle size of 1 to 6 μm in a diluted solution such as alcohol or pure water. Next, the observed section is polished at room temperature using colloidal silica containing no alkaline solution for 8 minutes to remove strain introduced into the surface layer of the observed section. The observed section is measured by an electron backscatter diffraction method at a measurement interval of 0.1 μm to obtain crystal orientation information. For the measurement, an apparatus including a thermal field-emission scanning electron microscope (JSM-7001F manufactured by JEOL Ltd.) and an EBSD detector (DVCS type detector manufactured by TSL) is used. At this time, the degree of vacuum in the apparatus is set to $9.6\times10^{-5}$ Pa or less, the acceleration voltage is set to 15 kv, the irradiation current level is set to 13, and the electron beam irradiation level is set to 62. The area ratio of residual austenite, which is an fcc structure, is calculated from the obtained crystal orientation information using the "Phase Map" function installed in the software "OIM Analysis (registered trademark)" attached to the EBSD analyzer, thereby obtaining the area ratio of residual austenite.

By distinguishing the structures from each other by the above-described method, the area ratio of martensite (fresh martensite and tempered martensite) is obtained.

The area ratio of the remainder in the microstructure is obtained by subtracting the area ratio of martensite from 100%.

"Number Density of Carbides Having Circle Equivalent Diameter of 0.20 μm or More Is $0.5/\mu m^2$ or Less"

When the microstructure of the hot-stamping formed body contains a large amount of coarse carbides, there are cases where the toughness of the hot-stamping formed body deteriorates. Therefore, it is desirable that the amount of coarse carbide is as small as possible. In the present embodiment, the number density of carbides having a circle equivalent diameter of 0.20 μm or more is preferably $0.5/\mu m^2$ or less. The number density thereof is more preferably $0.3/\mu m^2$ or less, and $0.2/\mu m^2$ or less. Since it is preferable that the number density of carbides having a circle equivalent diameter of 0.20 μm or more is smaller, the number density thereof may be set to $0/\mu m^2$.

(Method of Measuring Number Density of Carbides)

A sample is taken so that the sheet thickness cross section of the hot-stamping formed body becomes an observed section, and the observed section is finished by electrolytic polishing. Thereafter, a region from a t/8 thickness depth from the surface to a 3t/8 thickness depth from the surface is observed for 10 or more visual fields at a magnification of 20,000-fold. The circle equivalent diameter of each carbide is obtained from the observed area of each carbide by image analysis. By calculating the number density of carbides having a circle equivalent diameter of 0.20 μm or more, the number density of carbides having a circle equivalent diameter of 0.20 μm or more is obtained.

In the present embodiment, particles having a major axis of 5 nm or more present in the laths or in the form of laths in martensite are regarded as carbides.

"Tensile Strength"

The hot-stamping formed body according to the present embodiment may have a tensile (maximum) strength of 2,000 MPa or more. The tensile strength thereof is more preferably 2,200 MPa or more. The upper limit thereof is not particularly limited, but may be 2,600 MPa or less and 2,500 MPa or less.

The tensile (maximum) strength is obtained according to the test method described in JIS Z 2241:2011 by producing a No. 5 test piece described in JIS Z 2241:2011 from a position as flat as possible in the hot-stamping formed body.

"Toughness"

The hot-stamping formed body according to the present embodiment may have a value of 0.60 MPa/Hv or more, which is an index of early fracture properties, and a hardness variation (ΔHv) of 50 Hv or less. The value that is an index of the early fracture properties is a value (tensile strength/(average hardness×3.3)) obtained by dividing the tensile strength (unit: MPa) by a value obtained by multiplying an average hardness (unit: Hv) obtained by a method described later by 3.3. This value is preferably 0.75 MPa/Hv or more and 0.80 MPa/Hv or more. The value obtained by multiplying the average hardness by 3.3 is an estimated tensile strength which is estimated from the hardness. When an actual measurement value of the tensile strength is 0.60 MPa/Hv or more times the estimated tensile strength, early fracture properties are excellent, so that excellent toughness can be determined.

When the hardness variation (ΔHv) is 50 Hv or less, a stress concentration is less likely to occur in a case where deformation (stress) occurs from the outside in the hot-stamping formed body having a tensile strength of 2,000 MPa or more, so that excellent toughness can be determined. The hardness variation (ΔHv) is preferably 40 Hv or less, 30 Hv or less, and 20 Hv or less.

The average hardness used to calculate the index of early fracture properties is measured by the following method.

A test piece is cut out from any position (a position avoiding the end portion) of the hot-stamping formed body so that a sheet thickness cross section perpendicular to the surface can be observed. The length of the test piece depends on the measuring apparatus, but may be about 10 mm. The sheet thickness cross section of the test piece is polished using #600 to #1500 silicon carbide paper and thereafter mirror-finished using a liquid obtained by dispersing a diamond powder having a particle size of 1 to 6 μm in a diluted solution such as alcohol or pure water. This sheet thickness cross section is used as a measurement surface. Using a Micro Vickers hardness tester, Vickers hardnesses are measured at intervals of three or more times an indentation under a load of 1 kgf at a t/4 thickness position (a region from a t/8 thickness depth from the surface to a 3t/8 thickness depth from the surface) of the measurement surface. By measuring 20 points in total and calculating the average value thereof, the average value (average hardness) of the Vickers hardnesses is obtained.

The hardness variation (ΔHv) is obtained by calculating the difference between the maximum value and the minimum value of the Vickers hardnesses at the 20 points, which are obtained when the average hardness is obtained by the above method.

The hot-stamping formed body according to the present embodiment can be obtained by a manufacturing method in which a steel sheet for hot stamping is subjected to a first heat treatment and a second heat treatment. By performing the first heat treatment, a large amount of high angle grain boundaries are formed in prior austenite grains. During the second heat treatment, Mn is diffused from the prior austenite grain boundaries to the high angle grain boundaries in the prior austenite grains. As a result, the Mn concentration at the prior austenite grain boundaries can be reduced in the microstructure of the hot-stamping formed body. That is, it is preferable that a sufficient amount of high angle grain boundaries is formed in the steel sheet for hot stamping (steel sheet after the first heat treatment and before the second heat treatment), which is to be processed into the hot-stamping formed body according to the present embodiment.

In the steel sheet for hot stamping, which is to be processed into the hot-stamping formed body according to the present embodiment, it is preferable that the proportion of the high angle grain boundaries at a t/4 thickness position (a region from a t/8 thickness depth from the surface to a 3t/8 thickness depth from the surface) is 40% or more. However, even if the proportion of the high angle grain boundaries of the steel sheet for hot stamping is less than 40%, the hot-stamping formed body according to the present embodiment can be manufactured depending on the manufacturing conditions after the first heat treatment. Therefore, the proportion of the high angle grain boundaries of the steel sheet for hot stamping is not particularly limited.

(Method of Calculating Proportion of High Angle Grain Boundaries)

A method of calculating the proportion of the high angle grain boundaries of the steel sheet for hot stamping will be described.

A test piece is cut out from any position on the steel sheet for hot stamping so that a cross section perpendicular to the surface (sheet thickness cross section) can be observed. The length of the test piece depends on the measuring apparatus, but may be about 10 mm. The cross section of the test piece is polished using #600 to #1500 silicon carbide paper and thereafter mirror-finished using a liquid obtained by dispersing a diamond powder having a particle size of 1 to 6 μm in a diluted solution such as alcohol or pure water. This sheet thickness cross section is used as an observed section.

Next, the observed section is polished at room temperature using colloidal silica containing no alkaline solution for 8 minutes to remove strain introduced into the surface layer of the test piece. At any position in the longitudinal direction of the observed section, the t/4 thickness position of the steel sheet (a region from a t/8 thickness depth from the surface to a 3t/8 thickness depth from the surface) is measured by an electron backscatter diffraction method at a measurement interval of 0.1 μm to obtain crystal orientation information. For the measurement, an apparatus including a thermal field-emission scanning electron microscope (JSM-7001F manufactured by JEOL Ltd.) and an EBSD detector (DVCS type detector manufactured by TSL) is used. At this time, the degree of vacuum in the apparatus is set to $9.6\times10^{-5}$ Pa or less, the acceleration voltage is set to 15 kv, the irradiation current level is set to 13, and the electron beam irradiation time is set to 0.01 sec/point.

The proportion of the lengths of grain boundaries in which the rotation angle between adjacent crystal lattices 15° or more in the sum of the lengths of the grain boundaries in which the rotation angle is 15° or more and the lengths of grain boundaries in which rotation angle is less than 15° is calculated from the obtained crystal orientation information using the "Image Quality" function installed in the software "OIM Analysis (registered trademark)" attached to the EBSD analyzer. With this function, regarding the grain boundaries of grains having a body-centered cubic structure, the length of the sum of grain boundaries having any rotation angle can be calculated. Regarding all the grains included in the measurement region, the length of the sum of such grain boundaries is calculated, and the proportion of the lengths of the grain boundaries in which the rotation angle is 15° or more is obtained. This proportion is defined as the proportion of the high angle grain boundaries.

<Method of Manufacturing Hot-Stamping Formed Body>

Next, a preferred manufacturing method of the hot-stamping formed body according to the present embodiment will be described. First, a method of manufacturing the steel sheet for hot stamping applied to the hot-stamping formed body according to the present embodiment will be described.

(Method of Manufacturing Steel Sheet for Hot Stamping)

"Heating Step"

A steel piece (steel) to be subjected to hot rolling may be a steel piece manufactured by an ordinary method, and may be, for example, a steel piece manufactured by a general method such as a continuously cast slab or a thin slab caster. It is preferable that the steel having the above-described chemical composition is subjected to hot rolling to be heated in a temperature range of 1,100° C. or higher in a hot rolling step, and is held in this temperature range for 20 minutes or longer. In a case where the heating temperature is lower than 1,100° C. or the retention time is shorter than 20 minutes, re-dissolving of coarse inclusions such as Ti does not proceed and the coarse inclusions remain as fracture origins, so that there are cases where the toughness of the hot-stamping formed body deteriorates. More preferably, the heating temperature is 1,200° C. or higher, and the retention time is 25 minutes or longer. The heating temperature is preferably 1,400° C. or lower, and the retention time is preferably 120 minutes or shorter.

"Finish Rolling Step"

Next, it is preferable to perform hot rolling so that the completion temperature of finish rolling (finish rolling temperature) is in a temperature range of an $Ar_3$ point or higher. When the finish rolling is completed at a temperature lower than the $Ar_3$ point, there are cases where dual phase rolling is performed and the shape of the sheet during the rolling deteriorates. Therefore, the finish rolling temperature is preferably set to the $Ar_3$ point or higher. More preferably, the finish rolling temperature is the $Ar_3$ point+10° C. or higher. The finish rolling temperature is preferably set to the $Ar_3$ point+100° C. or lower.

The $Ar_3$ point is represented by Expression (1). Each element symbol in Expression (1) indicates the amount (mass %) of the corresponding element. In a case where the corresponding elements are not contained, 0 is substituted.

$$Ar_3\ \text{point}=850+10\times(C+N)\times Mn+350\times Nb+250\times Ti+40\times B+10\times Cr+100\times Mo \quad \text{Expression (1)}$$

"Coiling Step"

The steel sheet after the finish rolling is coiled into a coil shape in a temperature range of 750° C. or lower. When the coiling temperature exceeds 750° C., a large amount of scale is generated, which makes it difficult to remove the scale in a pickling step which is a subsequent step. Therefore, the coiling temperature is preferably set to 750° C. or lower. The coiling temperature is more preferably 600° C. or lower. In addition, the coiling temperature is preferably set to 400° C. or higher.

A hot-rolled steel sheet is obtained by the above method.

The hot-rolled steel sheet obtained by the above method may be subjected to a re-heating treatment for the purpose of softening, as necessary. A cold-rolled steel sheet may be obtained by cold-rolling the hot-rolled steel sheet, or a plated steel sheet may be obtained by applying plating. In addition, continuous annealing may also be performed.

The cold rolling may be cold rolling performed at a normal cumulative rolling reduction of, for example, 30% to 90%. The hot-rolled steel sheet may be subjected to a hot stamping step without being subjected to the cold rolling.

The hot-rolled steel sheet or the cold-rolled steel sheet may have a plating layer on the surface. Various known hot-dip metal plating, electro plating, and the like may be performed depending on the purpose such as suppressing the generation of scale in the hot stamping step and improving the corrosion resistance of the hot-stamping formed body.

Examples of the hot-dip metal plating include hot-dip galvanizing, hot-dip galvannealing, hot-dip aluminum plating, and hot-dip aluminum-zinc plating. When a hot-dip metal plating layer is full hard, there are cases where a crack occurs during hot-stamping forming and the corrosion resistance of the hot-stamping formed body deteriorates. Therefore, the hot-dip metal plating is preferably hot-dip galvanizing or hot-dip galvannealing in which the plating layer becomes soft.

In a case where the hot-dip metal plating is hot-dip galvanizing or hot-dip galvannealing, the amount of plating adhered to the surface of the hot-rolled steel sheet or cold-rolled steel sheet is preferably 3 to 800 $g/m^2$ per surface. When the plating adhesion amount is less than 3 $g/m^2$ per surface, there are cases where the effect of improving corrosion resistance cannot be reliably obtained. On the other hand, when the plating adhesion amount exceeds 800 $g/m^2$ per surface, there are cases where defects such as blowholes easily occur during welding. From the viewpoint of improving corrosion resistance and suppressing an increase in cost, it is more preferable that the plating adhesion amount is 10 to 200 $g/m^2$.

In order to suppress evaporation of the plating layer before hot-stamping forming and improve the corrosion resistance of the hot-stamping formed body, it is preferable that the plating is hot-dip galvannealing. As for the degree of alloying of the hot-dip galvannealing, it is preferable that the Fe content in the plating layer is 3% to 25%. When the Fe content in the plating layer is less than 3%, there are cases where evaporation of the plating layer during hot-stamping forming cannot be sufficiently suppressed. When the Fe content in the plating layer exceeds 25%, there are cases where the powdering property of the hot-stamping formed body deteriorates.

From the viewpoint of suppressing evaporation of the plating layer and securing the powdering property, the Fe content in the plating layer is more preferably 7% to 18%. The surface of the hot-dip galvanized layer or the hot-dip galvannealed layer may be further subjected to an organic or inorganic coating.

(Method of Manufacturing Hot-Stamping Formed Body)

Using the steel sheet for hot stamping obtained by the above method, for example, the hot-stamping formed body according to the present embodiment is manufactured by the following manufacturing method. As described above, in the present embodiment, two heat treatments are performed in order to obtain a desired microstructure in the hot-stamping formed body.

(First Heat Treatment) Heating Temperature T1: $Ac_3$ Point to $Ac_3$+200° C.

Regarding the hot-stamping formed body according to the present embodiment, the steel sheet for hot stamping is subjected to the first heat treatment before being subjected to the hot stamping step. In the first heat treatment, heating to a heating temperature T1 of an $Ac_3$ point to the $Ac_3$ point+200° C. and holding at this temperature T1 are performed. In the heating of this first heat treatment, Mn is concentrated at the prior austenite grain boundaries. In a case where the heating temperature T1 is lower than the $Ac_3$ point, the concentration of Mn in the prior austenite grain boundaries does not proceed sufficiently, and the Mn concentration cannot be sufficiently reduced in the subsequent second heat treatment. Therefore, the heating temperature T1 is set to the $Ac_3$ point or higher. The heating temperature T1 is preferably the $Ac_3$ point+20° C. or higher. On the other hand, in a case where the heating temperature T1 exceeds the $Ac_3$ point+200° C., there are cases where the prior austenite grains become coarse and the average grain size of the prior austenite grains cannot be set to 5.0 μm or less. Therefore, the heating temperature T1 is set to $Ac_3$+200° C. or lower. The average heating rate up to the heating temperature T1 may be 1 to 30° C./s.

The $Ac_3$ point can be obtained from Expression (2).

$$Ac_3 \text{ point } (^\circ\text{ C.}) = 912 - 230.5 \times C + 31.6 \times Si - 20.4 \times Mn - 14.8 \times Cr + 16.8 \times Mo \quad \text{Expression (2)}$$

Each element symbol in Expression (2) indicates the amount (mass %) of the corresponding element. In a case where the corresponding elements are not contained, 0 is substituted.

The steel sheet for hot stamping heated to the heating temperature T1 is held at the heating temperature T1. The retention time is not limited, but is preferably set to 60 seconds to 20 minutes. In a case where the retention time is shorter than 60 seconds, the re-dissolving of carbides does not proceed, coarse carbides remain undissolved, and the number density of the carbides becomes too high, so that there are cases where a desired microstructure cannot be obtained. In a case where the retention time is longer than 20 minutes, the prior austenite grains may be excessively coarsened, the proportion of high angle grain boundaries may be reduced, so that there are cases where a desired microstructure cannot be obtained.

(First Heat Treatment) Average Cooling Rate to Cooling Stop Temperature: 10° C./s to 500° C./s Cooling is performed so that the average cooling rate from the heating temperature T1 to a cooling stop temperature, which will be described later, is 10° C./s to 500° C./s. By this cooling, the microstructure has martensite as the primary phase, so that a large amount of high angle grain boundaries are introduced into the prior austenite grains. Fine austenite is present at a block interface, which is the high angle grain boundary, and this has a strong effect on the refinement of austenite during the second heat treatment and a reduction in the Mn concentration at the prior austenite grain boundaries. That is, since this high angle grain boundary serves as a diffusion path for Mn of the prior austenite grain boundaries in the second heat treatment, the high angle grain boundary plays an important role in reducing the Mn concentration at the prior austenite grain boundaries.

In a case where the average cooling rate from the heating temperature T1 to the cooling stop temperature described later is slower than 10° C./s, a soft phase such as ferrite may be formed, and the introduction of high angle grain boundaries becomes insufficient. As a result, the reduction in the Mn concentration at the prior austenite grain boundaries in the second heat treatment becomes insufficient, and there are cases where the average Mn concentration at the prior austenite grain boundaries cannot be reduced to 1.0 mass % or less. Therefore, the average cooling rate is set to 10° C./s or faster. The average cooling rate is preferably 20° C./s or faster. On the other hand, in a case where the cooling rate exceeds 500° C./s, an internal stress associated with martensitic transformation increases, and there are cases where a crack occurs in a cooling process to room temperature. Therefore, the average cooling rate is set to 500° C./s or slower. The average cooling rate is preferably 300° C./s or slower.

(First Heat Treatment) Cooling Stop Temperature: 250° C. to 400° C.

In the cooling of the first heat treatment, it is necessary not only to simply form martensite but also to allow austenite to remain at the block interface of martensite. This is because, as described above, this remaining austenite serves as a diffusion path for Mn in the second heat treatment. In order to achieve stabilization of austenite, it is necessary to promote the diffusion of C from martensite into untransformed austenite. Therefore, cooling is stopped in a temperature range of 250° C. to 400° C. In a case where the cooling stop temperature is lower than 250° C., the diffusion of C from martensite into untransformed austenite does not proceed. Therefore, the cooling stop temperature is set to 250° C. or higher. The cooling stop temperature is preferably 260° C. or higher. In a case where the cooling stop temperature exceeds 400° C., carbides are generated and the stabilization of residual austenite between blocks does not proceed. Therefore, the cooling stop temperature is set to 400° C. or lower.

(First Heat Treatment) Average Cooling Rate at Cooling Stop Temperature or Lower: Slower than 10° C./s In order to allow austenite which serves as a diffusion path for Mn in the second heat treatment to remain, it is necessary to control the cooling rate to the cooling stop temperature or lower to promote the diffusion of carbon from martensite into untransformed austenite so that austenite is stabilized. In order to exhibit this action, the average cooling rate to the cooling stop temperature or lower is controlled to slower than 10° C./s. The average cooling rate is preferably 8° C./s or slower. In a case where the cooling rate to the cooling stop temperature or lower is 10° C./s or faster, the diffusion of carbon from martensite into untransformed austenite does not proceed, the stability of austenite decreases, so that residual austenite cannot remain. Therefore, there are cases where austenite grains become coarse in the heating process during the second heat treatment and the Mn concentration at the prior austenite grain boundaries cannot be reduced.

(Second Heat Treatment) Average Heating Rate: 10° C./s to 1,000° C./s

For the steel sheet for hot stamping subjected to the first heat treatment, in order to refine the prior austenite grains and reduce the Mn concentration at the prior austenite grain boundaries, the average heating rate of the heating (second heat treatment) during the hot stamping is controlled. By setting the average heating rate of the second heat treatment to 10° C./s or faster, the grain growth of the prior austenite grains can be suppressed. In addition, the diffusion of Mn from the prior austenite grain boundaries to the high angle grain boundaries with the high angle grain boundaries introduced in the first heat treatment as the diffusion path can proceed. As a result, the prior austenite grains can be refined and the Mn concentration at the prior austenite grain boundaries can be reduced. Accordingly, the toughness of the hot-stamping formed body can be improved. Therefore, the average heating rate is set to 10° C./s or faster. The average heating rate is preferably 30° C./s or faster. On the other hand, when the average heating rate exceeds 1,000° C./s, it becomes difficult to control the heating temperature of the hot-stamping formed body, and there are cases where the average grain size of the prior austenite grains cannot be 5.0 μm or less depending on the portion. As a result, there are cases where the toughness of the hot-stamping formed body deteriorates. Therefore, the average heating rate is set to 1,000° C./s or slower. The average heating rate is preferably 700° C./s or slower.

(Second Heat Treatment) Heating Temperature T2: $Ac_3$' Point to $Ac_3$' Point+100° C.

Mn is concentrated in residual austenite formed by the first heat treatment. Since Mn is an austenite stabilizing element, the $Ac_3$ point is lower than that of the first heat treatment. This lowered $Ac_3$ point is referred to as an "$Ac_3$' point", and a heating temperature during the second heat treatment is referred to as T2.

By setting the heating temperature T2 during the second heat treatment to the $Ac_3$' point to the $Ac_3$' point+100° C., Mn concentrated in the prior austenite grain boundaries in the first heat treatment with the high angle grain boundaries in the prior austenite grains as the diffusion path is diffused. Accordingly, the Mn concentration at the prior austenite grain boundaries is reduced. In a case where the heating temperature T2 is lower than the $Ac_3$' point, Mn is not sufficiently diffused from the prior austenite grain boundaries, and there are cases where the Mn concentration at the prior austenite grain boundaries exceeds 1.0 mass %. As a result, there are cases where the toughness of the hot-stamping formed body deteriorates. Therefore, the heating temperature T2 is set to $Ac_3$' point or higher. The heating temperature T2 is preferably $Ac_3$'+20° C. or higher. On the other hand, in a case where the heating temperature T2 exceeds the $Ac_3$' point+100° C., the grain growth of the prior austenite grains proceeds, and there are cases where the average grain size of the prior austenite grains exceeds 5.0 μm. As a result, there are cases where the toughness of the hot-stamping formed body deteriorates. Therefore, the heating temperature T2 is set to the $Ac_3$' point+100° C. or lower. The heating temperature T2 is preferably the $Ac_3$' point+80° C. or lower.

Regarding the $Ac_3$' point, the steel sheet for hot stamping after the first heat treatment is subjected to a thermal expansion measurement, a temperature at which the microstructure is completely austenitized is obtained from a change in the amount of thermal expansion during heating, and this temperature is determined as the $Ac_3$' point. An apparatus used for the thermal expansion measurement may be any apparatus that can continuously measure the amount of thermal expansion during heating, and for example, a thin sheet Formaster tester manufactured by Fuji Electronic Industrial Co., Ltd. may be used.

The retention time at the heating temperature T2 is set to longer than 10 seconds and 60 seconds or shorter. When the retention time is 10 seconds or shorter, the diffusion of Mn from the prior austenite grain boundaries into the high angle grain boundaries does not proceed sufficiently, so that there are cases where the amount of Mn of the prior austenite grain boundaries cannot be reduced. When the retention time exceeds 60 seconds, the growth of the prior austenite grains proceeds, and there are cases where the toughness deteriorates. A preferable retention time considering the balance between the refinement of the prior austenite grains and the diffusion of Mn from the austenite grain boundaries into the high angle grain boundaries is 20 seconds or longer and 30 seconds or shorter.

Furthermore, the difference (T2−cooling stop temperature) between the cooling stop temperature during the first heat treatment and the heating temperature T2 during the second heat treatment is set to lower than 600° C. When the T2−cooling stop temperature is 600° C. or higher, the grain growth of austenite proceeds in the heating stage during the second heat treatment, and there are cases where the average grain size of the prior austenite grains exceeds 5.0 μm and/or the average Mn concentration at the prior austenite grain boundaries increases. More preferably, the difference (T2−cooling stop temperature) between the cooling stop temperature during the first heat treatment and the heating temperature T2 during the second heat treatment is 570° C. or lower.

Figure 2:
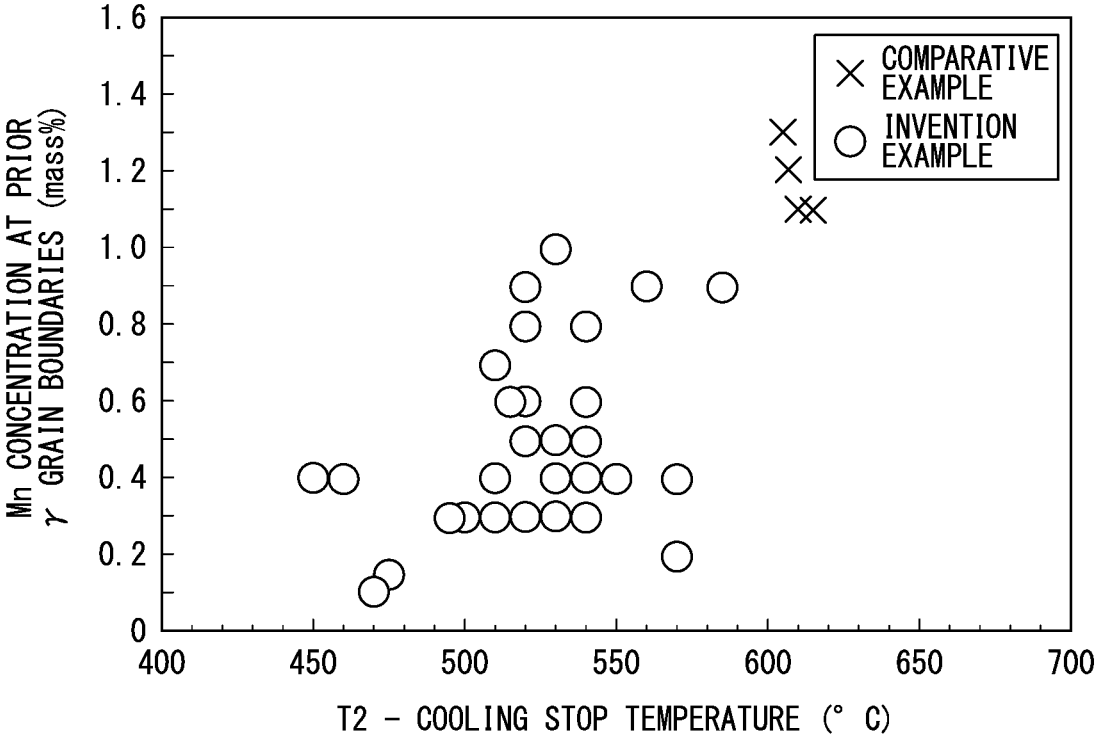
FIG. 2 is a diagram showing the relationship between T2−cooling stop temperature and the average Mn concentration at the grain boundaries of the prior austenite grains.
Figure 3:
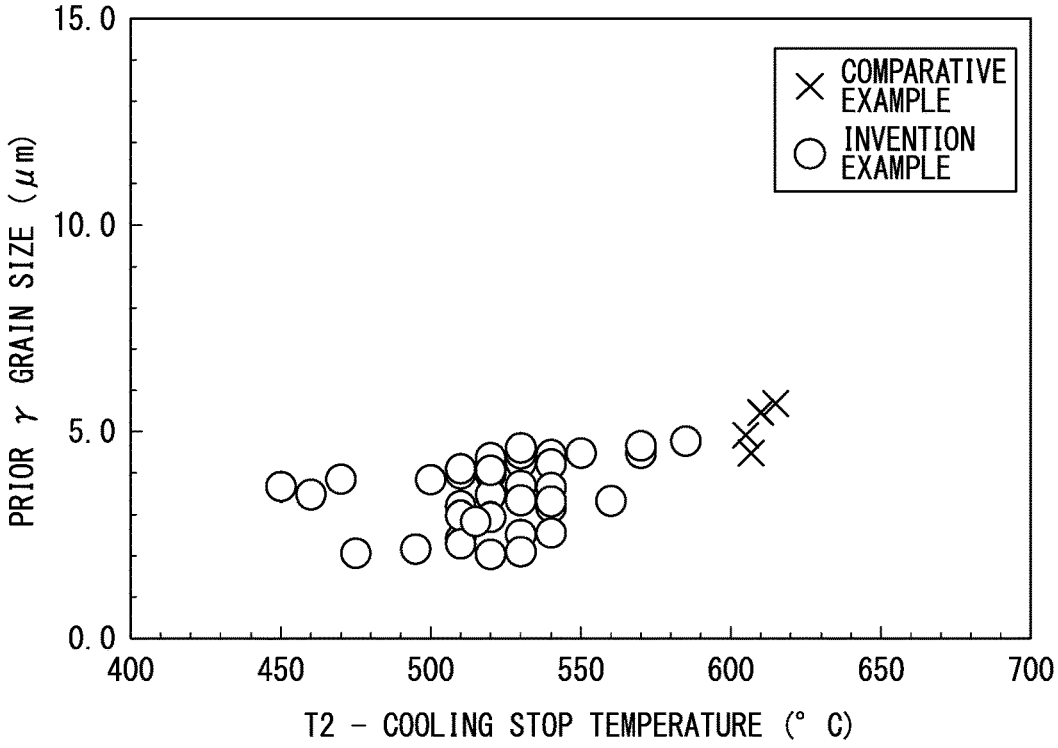
FIG. 3 is a diagram showing the relationship between T2–cooling stop temperature and the average grain size of the prior austenite grains.

FIG. 2 is a diagram showing the relationship between T2−cooling stop temperature and the average Mn concentration at the grain boundaries of the prior austenite grains in examples. FIG. 3 is a diagram showing the relationship between T2–cooling stop temperature and the average grain size of the prior austenite grains in the examples.

As shown in FIG. 2, it can be seen that by setting T2–cooling stop temperature to lower than 600° C., the average Mn concentration at the grain boundaries of the prior austenite grains becomes 1.0 mass % or less. In addition, as shown in FIG. 3, it can be seen that by setting T2–cooling stop temperature to lower than 600° C., the average grain size of the prior austenite grains becomes 5.0 μm or less.

Invention examples and comparative examples of FIGS. 2 and 3 are an extraction of some of all the invention examples and all the comparative examples in the examples.

Figure 4:
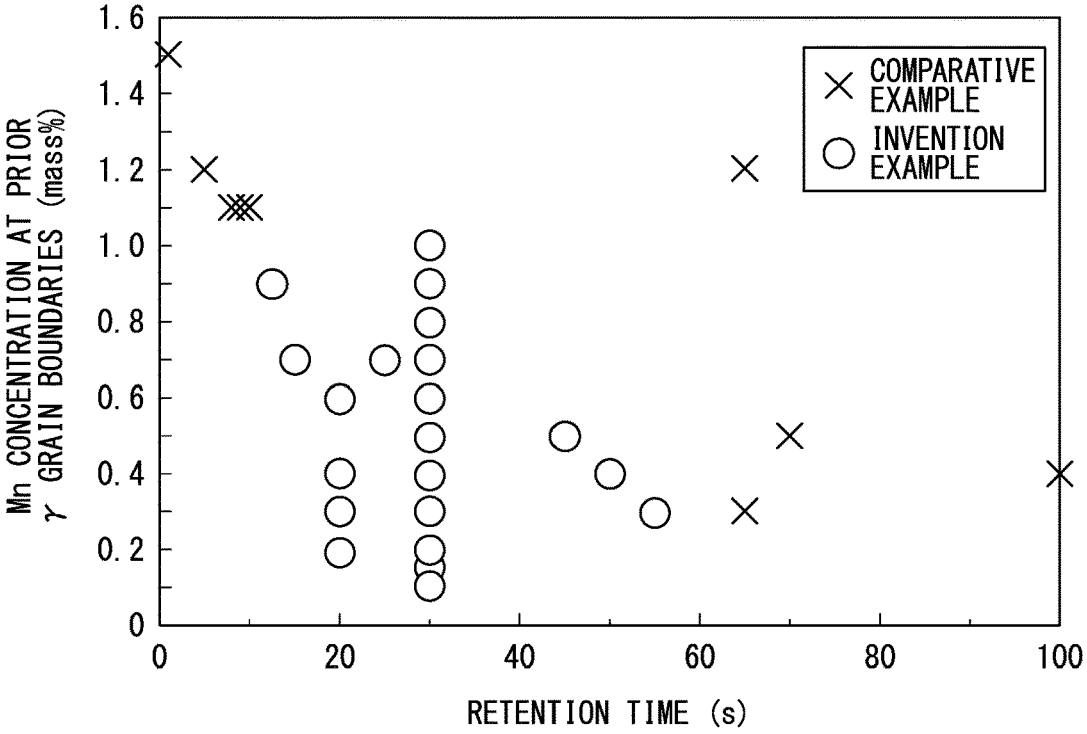
FIG. 4 is a diagram showing the relationship between a retention time at a heating temperature T2 and the average Mn concentration at the grain boundaries of the prior austenite grains.
Figure 5:
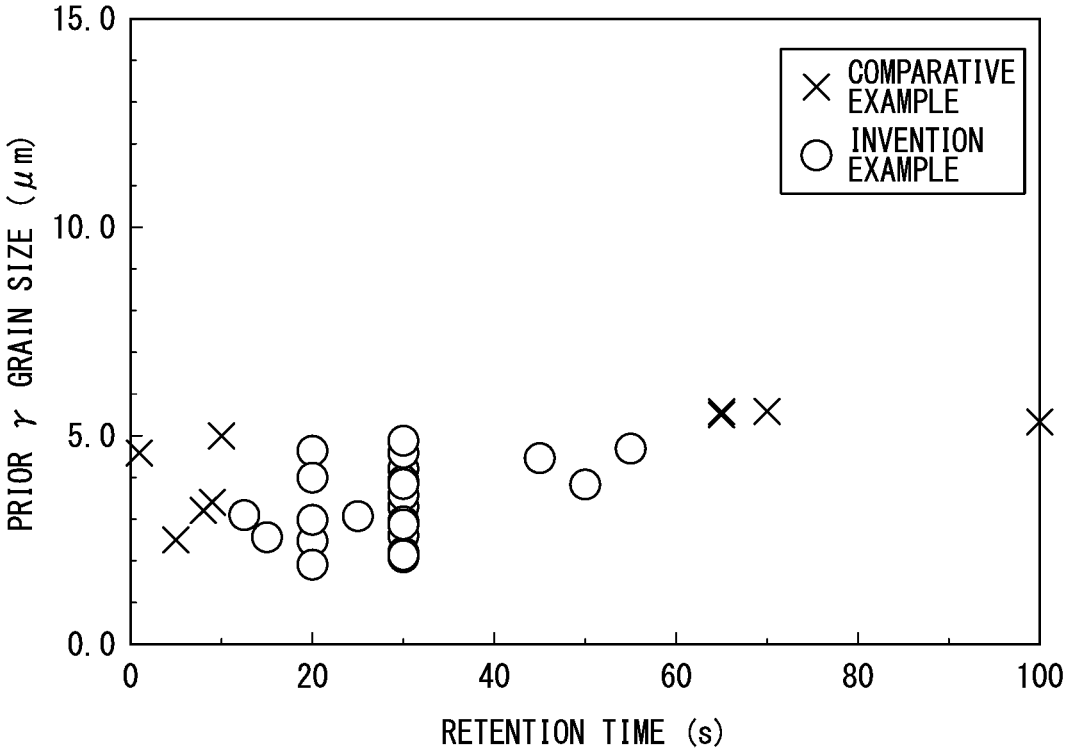
FIG. 5 is a diagram showing the relationship between s retention time at s heating temperature T2 and the average grain size of the prior austenite grains.

FIG. 4 is a diagram showing the relationship between the retention time at the heating temperature T2 and the average Mn concentration at the grain boundaries of the prior austenite grains in the examples. FIG. 5 is a diagram showing the relationship between the retention time at the heating temperature T2 and the average grain size of the prior austenite grains in the examples.

As shown in FIG. 4, it can be seen that by setting the retention time at the heating temperature T2 to longer than 10 seconds and 60 seconds or shorter, the average Mn concentration at the grain boundaries of the prior austenite grains becomes 1.0 mass % or less. In addition, as shown in FIG. 5, it can be seen that by setting the retention time at the heating temperature T2 to longer than 10 seconds and 60 seconds or shorter, the average grain size of the prior austenite grains becomes 5.0 μm or less.

Invention examples and comparative examples of FIGS. 4 and 5 are an extraction of some of all the invention examples and all the comparative examples in the examples.

The steel sheet for hot stamping heated to and held at the heating temperature T2 is formed into a hot-stamping formed body by hot stamping, and is cooled at the following cooling rate.

(Second Heat Treatment) Average Cooling Rate in Temperature Range to 200° C. after Hot-Stamping Forming: 10° C./s to 500° C./s By controlling the average cooling rate in a temperature range to 200° C. after hot-stamping forming to 10° C./s to 500° C./s, the microstructure of the hot-stamping formed body contains martensite (including fresh martensite and tempered martensite) as the primary phase. In a case where the average cooling rate is slower than 10° C./s, hardening is not sufficiently achieved, a soft phase such as ferrite is formed in the microstructure, and the toughness of the hot-stamping formed body deteriorates. Therefore, the average cooling rate is set to 10° C./s or faster. The average cooling rate is preferably 30° C./s or faster. On the other hand, in a case where the average cooling rate exceeds 500° C./s, the self-tempering of martensite does not proceed sufficiently, the internal stress in the microstructure increases, and there are cases where the toughness of the hot-stamping formed body deteriorates. Therefore, the average cooling rate is set to 500° C./s or slower. The average cooling rate is preferably 300° C./s or slower.

After the hot-stamping forming, for the purpose of adjusting the strength, tempering may be performed by heating to a temperature range of 100° C. to 600° C. and holding in the temperature range. In addition, for the purpose of improving the deformability of the hot-stamping formed body, a softened region may be formed in a portion of the hot-stamping formed body after hot stamping and cooling. The softened region mentioned here means a region formed by irradiating only a portion (for example, a flange portion) of the hot-stamping formed body with a laser and tempering the portion.

EXAMPLES

Next, the examples of the present invention will be described. However, the conditions in the examples are one example of conditions adopted to confirm the feasibility and effects of the present invention, and the present invention is not limited to this one example of conditions. The present invention can adopt various conditions as long as the object of the present invention is achieved without departing from the gist of the present invention.

Steels having the chemical compositions shown in Tables 1 to 3 were melted and continuously cast to obtain steel pieces. The steel piece was heated to 1,150° C., held in the temperature range for 30 minutes, and then hot-rolled so that the finish rolling temperature was 940° C., thereby obtaining a hot-rolled steel strip. The obtained hot-rolled steel strip was coiled into a coil shape at 580° C. The hot-rolled steel strip was cold-rolled under the condition that the cumulative rolling reduction was 50%, thereby obtaining a steel sheet for hot stamping (cold-rolled steel sheet) having a thickness of 1.4 mm.

Some of the steel sheets for hot stamping were hot-dip galvanized to obtain plated steel sheets for hot stamping. The amount of plating adhered was set to 10 to 200 g/m$^2$ per surface. For the steel sheets for hot stamping that had been hot-dip galvanized, "Present" is described in the "Plating" column in Tables 4 to 8.

Each of the steel sheets for hot stamping and the plated steel sheets for hot stamping (hereinafter collectively referred to as "steel sheets for hot stamping") were subjected to the first heat treatment (pre-heat treatment) and the second heat treatment shown in Tables 4 to 8 and subjected to hot stamping to obtain hot-stamping formed bodies. In Tables 4 to 8, "Cooling 1" indicates cooling from the heating temperature T1 to the "cooling stop temperature of 250° C. to 400° C.", "Cooling 2" indicates cooling in a temperature range to the cooling stop temperature or lower, and "Cooling 3" indicates the average cooling rate in a temperature range to 200° C. after hot-stamping forming.

In addition, some of the hot-stamping formed bodies were tempered by heating to a temperature range of 100° C. to 600° C. and holding for the purpose of adjusting the strength. For the hot-stamping formed bodies that had been tempered, "Present" is described in the "Annealing" column in Tables 4 to 8.

Furthermore, for some of the hot-stamping formed bodies, a portion of the hot-stamping formed body was irradiated with a laser to be heated to 200° C., thereby forming a partially softened region. Regarding the hot-stamping formed bodies in which the partially softened region was formed, "Present" is described in the "Partially softened region" column in Tables 9 to 13.

The microstructure of the steel sheets for hot stamping and the hot-stamping formed bodies was measured by the above-mentioned measurement methods. In addition, the mechanical properties of the hot-stamping formed body were measured. The results are shown in Tables 9 to 13. The mechanical properties of the hot-stamping formed body were measured and evaluated by the following methods.

In Test No. 66 in Tables 6 and 11, the cooling rate during the first heat treatment was too fast and a crack had occurred, so that the microstructure and the like of the hot-stamping formed body were not observed.

"Tensile Strength"

The tensile strength of the hot-stamping formed body was obtained in accordance with the test method described in JIS Z 2241:2011 by producing a No. 5 test piece described in JIS Z 2241:2011 from a position as flat as possible in the hot-stamping formed body. In a case where the tensile strength was 2,000 MPa or more, having excellent strength and being acceptable was determined. On the other hand, in a case where the tensile strength was less than 2,000 MPa, not having excellent strength and being unacceptable was determined.

"Hardness"

A test piece was cut out from any position (a position avoiding the end portion) of the hot-stamping formed body so that a cross section (sheet thickness cross section) perpendicular to the surface could be observed. The length of the test piece was set to about 10 mm. The sheet thickness cross section of the test piece was polished using #600 to #1500 silicon carbide paper and thereafter mirror-finished using a liquid obtained by dispersing a diamond powder having a particle size of 1 to 6 μm in a diluted solution such as alcohol or pure water. This sheet thickness cross section was used as a measurement surface. Using a Micro Vickers hardness tester, Vickers hardnesses were measured at intervals of three or more times an indentation under a load of 1 kgf at a t/4 thickness position (a region from a t/8 thickness depth from the surface to a 3t/8 thickness depth from the surface) of the measurement surface. By measuring 20 points in total and calculating the average value thereof, the average value (average hardness) of the Vickers hardnesses was obtained. The average hardness obtained by this method was used for toughness evaluation described below.

In a case where the average hardness is 650 Hv or more, having sufficient hardness can be determined.

"Toughness"

The toughness of the hot-stamping formed body was evaluated by early fracture properties and hardness variation (ΔHv). A value obtained by dividing the tensile strength (unit: MPa) of the hot-stamping formed body by a value obtained by multiplying an average hardness (unit: Hv) by 3.3 was determined as a value which is an index of the early fracture properties. The tensile strength and the average hardness are values obtained by the above methods.

The value obtained by multiplying the average hardness by 3.3 is a tensile strength which is estimated from the hardness. When an actual measurement value of the tensile strength is 0.60 MPa/Hv or more times the estimated tensile strength, excellent early fracture properties can be determined.

"Hardness Variation (ΔAv)"

In a hot-stamping formed body having a tensile strength of 2,000 MPa or more, in a case where deformation (stress) occurs from the outside, a stress concentration occurs when the hardness variation (ΔHv) is large in the hot-stamping formed body, and there are cases where the toughness deteriorates. The toughness deteriorates in a case where the hardness variation (ΔHv) exceeds 50 Hv.

The hardness variation (ΔHv) was defined as the difference between the maximum value and the minimum value of the Vickers hardnesses at the 20 points, which were obtained when the average hardness was obtained by the above method.

In a case where the value as an index of the early fracture properties was 0.60 MPa/Hv or more and the hardness variation (ΔHv) was 50 Hv or less, being excellent in toughness and being acceptable was determined. In a case where either one was not satisfied, being inferior in toughness and being unacceptable was determined.

TABLE 1

| Steel | Chemical composition (mass %) of steel sheet for hot stamping, remainder consisting of Fe and impurities | | | | | | | | | |
|---|---|---|---|---|---|---|---|---|---|---|
| No. | C | Si | Mn | Sol. Al | Ti | Cr | B | P | S | N |
| 1 | 0.62 | 0.08 | 1.36 | 0.054 | 0.060 | 0.15 | 0.0031 | 0.013 | 0.0030 | 0.0030 |
| 2 | 0.40 | 0.50 | 1.80 | 0.033 | 0.010 | 0.01 | 0.0010 | 0.010 | 0.0016 | 0.0032 |
| 3 | 0.59 | 0.22 | 2.30 | 0.061 | 0.040 | 0.01 | 0.0021 | 0.006 | 0.0016 | 0.0016 |
| 4 | 0.37 | 0.20 | 0.40 | 0.030 | 0.020 | 0.20 | 0.0015 | 0.010 | 0.0008 | 0.0030 |
| 5 | 0.40 | 0.14 | 1.30 | 0.040 | 0.020 | 0.20 | 0.0019 | 0.016 | 0.0007 | 0.0021 |
| 6 | 0.55 | 0.22 | 0.40 | 0.035 | 0.020 | 0.21 | 0.0020 | 0.008 | 0.0030 | 0.0020 |
| 7 | 0.70 | 0.50 | 0.40 | 0.350 | 0.020 | 0.30 | 0.0030 | 0.010 | 0.0003 | 0.0024 |
| 8 | 0.72 | 0.26 | 0.42 | 0.100 | 0.024 | 0.05 | 0.0014 | 0.018 | 0.0010 | 0.0030 |
| 9 | 0.45 | 0.005 | 0.50 | 0.030 | 0.021 | 0.25 | 0.0015 | 0.011 | 0.0008 | 0.0020 |
| 10 | 0.47 | 0.010 | 0.60 | 0.100 | 0.022 | 0.36 | 0.0013 | 0.016 | 0.0010 | 0.0018 |
| 11 | 0.44 | 0.70 | 0.50 | 0.040 | 0.030 | 0.30 | 0.0018 | 0.015 | 0.0020 | 0.0022 |
| 12 | 0.45 | 1.21 | 0.45 | 0.031 | 0.021 | 0.10 | 0.0020 | 0.010 | 0.0007 | 0.0030 |
| 13 | 0.50 | 1.40 | 1.20 | 0.100 | 0.024 | 0.20 | 0.0012 | 0.010 | 0.0009 | 0.0015 |
| 14 | 0.40 | 0.20 | 0.30 | 0.040 | 0.025 | 0.30 | 0.0016 | 0.010 | 0.0008 | 0.0020 |
| 15 | 0.44 | 0.22 | 0.40 | 0.073 | 0.024 | 0.40 | 0.0014 | 0.020 | 0.0006 | 0.0018 |
| 16 | 0.47 | 0.24 | 1.70 | 0.035 | 0.025 | 0.35 | 0.0024 | 0.010 | 0.0008 | 0.0019 |
| 17 | 0.45 | 0.30 | 3.00 | 0.100 | 0.028 | 0.05 | 0.0011 | 0.020 | 0.0006 | 0.0015 |
| 18 | 0.45 | 0.26 | 3.20 | 0.044 | 0.022 | 0.20 | 0.0011 | 0.018 | 0.0010 | 0.0021 |
| 19 | 0.45 | 0.10 | 0.45 | 0.045 | 0.020 | 0.45 | 0.0010 | 0.001 | 0.0006 | 0.0018 |
| 20 | 0.42 | 0.03 | 0.73 | 0.020 | 0.027 | 0.16 | 0.0017 | 0.010 | 0.0016 | 0.0024 |
| 21 | 0.46 | 0.18 | 0.40 | 0.030 | 0.020 | 0.02 | 0.0020 | 0.100 | 0.0005 | 0.0018 |
| 22 | 0.44 | 0.30 | 0.45 | 0.100 | 0.022 | 0.20 | 0.0012 | 0.110 | 0.0009 | 0.0015 |
| 23 | 0.44 | 0.30 | 0.50 | 0.045 | 0.024 | 0.24 | 0.0011 | 0.020 | 0.0001 | 0.0015 |
| 24 | 0.44 | 0.25 | 0.51 | 0.044 | 0.023 | 0.20 | 0.0015 | 0.010 | 0.0050 | 0.0020 |
| 25 | 0.44 | 0.10 | 0.46 | 0.100 | 0.020 | 0.50 | 0.0010 | 0.018 | 0.0100 | 0.0018 |

TABLE 1-continued

| | | | | | | | | | | |
|---|---|---|---|---|---|---|---|---|---|---|
| 26 | 0.44 | 0.30 | 0.45 | 0.080 | 0.024 | 0.21 | 0.0012 | 0.010 | 0.0110 | 0.0015 |
| 27 | 0.45 | 0.30 | 0.50 | 0.100 | 0.005 | 0.40 | 0.0010 | 0.012 | 0.0010 | 0.0018 |
| 28 | 0.46 | 0.22 | 0.80 | 0.073 | 0.010 | 0.24 | 0.0012 | 0.010 | 0.0003 | 0.0024 |
| 29 | 0.47 | 0.30 | 0.45 | 0.047 | 0.050 | 0.20 | 0.0019 | 0.010 | 0.0005 | 0.0020 |
| 30 | 0.47 | 0.26 | 0.46 | 0.100 | 0.100 | 0.24 | 0.0015 | 0.012 | 0.0005 | 0.0021 |

| Steel | Chemical composition (mass %) of steel sheet for hot stamping, remainder consisting of Fe and impurities | | | | | | | | $Ac_3$ | |
|---|---|---|---|---|---|---|---|---|---|---|
| No. | Nb | Mo | V | Ni | REM | Mg | Ca | Co | (° C.) | Note |
| 1 | | | | | | | | | 742 | Invention Steel |
| 2 | 0.020 | | | | | | | | 799 | Invention Steel |
| 3 | 0.055 | 0.38 | | | | | | | 742 | Invention Steel |
| 4 | | | | | | | | | 822 | Comparative Steel |
| 5 | | | | | | | | | 795 | Invention Steel |
| 6 | | | | | | | | | 781 | Invention Steel |
| 7 | | | | | | | | | 754 | Invention Steel |
| 8 | | | | | | | | | 745 | Comparative Steel |
| 9 | | | | | | | | | 795 | Comparative Steel |
| 10 | | | | | | | | | 786 | Invention Steel |
| 11 | | | | | | | | | 818 | Invention Steel |
| 12 | | | | | | | | | 836 | Invention Steel |
| 13 | | | | | | | | | 814 | Comparative Steel |
| 14 | | | | | | | | | 816 | Comparative Steel |
| 15 | | | | | | | | | 803 | Invention Steel |
| 16 | | | | | | | | | 771 | Invention Steel |
| 17 | | | | | | | | | 757 | Invention Steel |
| 18 | | | | | | | | | 749 | Comparative Steel |
| 19 | | | | | | | | | 795 | Invention Steel |
| 20 | | | | | | | | | 799 | Invention Steel |
| 21 | | | | | | | | | 804 | Invention Steel |
| 22 | | | | | | | | | 808 | Comparative Steel |
| 23 | | | | | | | | | 806 | Invention Steel |
| 24 | | | | | | | | | 805 | Invention Steel |
| 25 | | | | | | | | | 797 | Invention Steel |
| 26 | | | | | | | | | 808 | Comparative Steel |
| 27 | | | | | | | | | 801 | Comparative Steel |
| 28 | | | | | | | | | 792 | Invention Steel |
| 29 | | | | | | | | | 801 | Invention Steel |
| 30 | | | | | | | | | 799 | Invention Steel |

Underline means outside the range specified in the present invention.

TABLE 2

| Steel | Chemical composition (mass %) of steel sheet for hot stamping, remainder consisting of Fe and impurities | | | | | | | | | | |
|---|---|---|---|---|---|---|---|---|---|---|---|
| No. | C | Si | Mn | Sol. Al | Ti | Cr | B | P | S | N | Nb |
| 31 | 0.46 | 0.31 | 0.60 | 0.040 | 0.130 | 0.10 | 0.0021 | 0.011 | 0.0008 | 0.0040 | |
| 32 | 0.47 | 0.25 | 0.45 | 0.030 | 0.030 | 0.005 | 0.0017 | 0.010 | 0.0007 | 0.0025 | |
| 33 | 0.47 | 0.30 | 0.45 | 0.031 | 0.021 | 0.010 | 0.0021 | 0.010 | 0.0005 | 0.0032 | |
| 34 | 0.46 | 0.33 | 0.45 | 0.030 | 0.022 | 0.42 | 0.0020 | 0.011 | 0.0008 | 0.0026 | |
| 35 | 0.47 | 0.30 | 0.45 | 0.030 | 0.020 | 0.79 | 0.0020 | 0.011 | 0.0003 | 0.0037 | |
| 36 | 0.45 | 0.30 | 1.30 | 0.100 | 0.020 | 0.85 | 0.0015 | 0.012 | 0.0006 | 0.0030 | |
| 37 | 0.40 | 0.10 | 0.48 | 0.058 | 0.028 | 0.36 | 0.0001 | 0.018 | 0.0006 | 0.0015 | |
| 38 | 0.47 | 0.18 | 0.46 | 0.030 | 0.020 | 0.36 | 0.0005 | 0.020 | 0.0006 | 0.0015 | |
| 39 | 0.45 | 0.20 | 0.40 | 0.080 | 0.040 | 0.50 | 0.0053 | 0.010 | 0.0009 | 0.0011 | |
| 40 | 0.46 | 0.80 | 1.40 | 0.059 | 0.028 | 0.20 | 0.0100 | 0.020 | 0.0005 | 0.0009 | |
| 41 | 0.45 | 0.22 | 1.20 | 0.060 | 0.030 | 0.30 | 0.0150 | 0.010 | 0.0020 | 0.0025 | |
| 42 | 0.45 | 0.31 | 0.80 | 0.0005 | 0.023 | 0.20 | 0.0020 | 0.014 | 0.0009 | 0.0030 | |
| 43 | 0.46 | 0.30 | 0.60 | 0.002 | 0.024 | 0.28 | 0.0013 | 0.010 | 0.0009 | 0.0015 | |
| 44 | 0.45 | 0.20 | 1.10 | 0.250 | 0.025 | 0.20 | 0.0020 | 0.015 | 0.0010 | 0.0027 | |
| 45 | 0.45 | 0.55 | 2.00 | 0.500 | 0.024 | 0.32 | 0.0014 | 0.020 | 0.0006 | 0.0024 | |
| 46 | 0.46 | 0.18 | 0.46 | 0.550 | 0.030 | 0.24 | 0.0011 | 0.018 | 0.0007 | 0.0021 | |
| 47 | 0.46 | 0.20 | 0.48 | 0.030 | 0.020 | 0.20 | 0.0014 | 0.012 | 0.0005 | 0.0002 | |
| 48 | 0.47 | 0.30 | 1.00 | 0.040 | 0.030 | 0.30 | 0.0024 | 0.012 | 0.0007 | 0.0050 | |
| 49 | 0.46 | 0.26 | 0.42 | 0.100 | 0.080 | 0.28 | 0.0011 | 0.020 | 0.0003 | 0.0100 | |
| 50 | 0.44 | 0.30 | 0.44 | 0.030 | 0.028 | 0.32 | 0.0012 | 0.014 | 0.0006 | 0.0150 | |
| 51 | 0.46 | 0.24 | 0.41 | 0.031 | 0.030 | 0.29 | 0.0025 | 0.014 | 0.0007 | 0.0023 | |
| 52 | 0.47 | 0.20 | 0.43 | 0.037 | 0.022 | 0.30 | 0.0022 | 0.015 | 0.0008 | 0.0026 | |
| 53 | 0.46 | 0.19 | 0.44 | 0.046 | 0.020 | 0.22 | 0.0021 | 0.008 | 0.0006 | 0.0027 | |
| 54 | 0.45 | 0.17 | 0.48 | 0.031 | 0.027 | 0.25 | 0.0017 | 0.011 | 0.0011 | 0.0023 | |
| 55 | 0.45 | 0.19 | 0.41 | 0.046 | 0.026 | 0.27 | 0.0023 | 0.007 | 0.0014 | 0.0016 | |
| 56 | 0.46 | 0.17 | 0.42 | 0.040 | 0.023 | 0.27 | 0.0018 | 0.009 | 0.0011 | 0.0024 | |
| 57 | 0.46 | 0.21 | 0.41 | 0.045 | 0.026 | 0.22 | 0.0023 | 0.011 | 0.0009 | 0.0029 | 0.050 |

TABLE 2-continued

| | | | | | | | | | | | |
|---|---|---|---|---|---|---|---|---|---|---|---|
| 58 | 0.47 | 0.23 | 0.45 | 0.045 | 0.021 | 0.25 | 0.0022 | 0.013 | 0.0007 | 0.0023 | 0.100 |
| 59 | 0.46 | 0.19 | 0.47 | 0.045 | 0.025 | 0.26 | 0.0022 | 0.010 | 0.0011 | 0.0026 | |
| 60 | 0.46 | 0.21 | 0.47 | 0.049 | 0.023 | 0.29 | 0.0024 | 0.014 | 0.0014 | 0.0021 | |

| Steel | Chemical composition (mass %) of steel sheet for hot stamping, remainder consisting of Fe and impurities | | | | | | | $Ac_3$ | |
|---|---|---|---|---|---|---|---|---|---|
| No. | Mo | V | Ni | REM | Mg | Ca | Co | (° C.) | Note |
| 31 | | | | | | | | 802 | Comparative Steel |
| 32 | | | | | | | | 802 | Comparative Steel |
| 33 | | | | | | | | 804 | Invention Steel |
| 34 | | | | | | | | 801 | Invention Steel |
| 35 | | | | | | | | 792 | Invention Steel |
| 36 | | | | | | | | 778 | Comparative Steel |
| 37 | | | | | | | | 808 | Comparative Steel |
| 38 | | | | | | | | 795 | Invention Steel |
| 39 | | | | | | | | 799 | Invention Steel |
| 40 | | | | | | | | 800 | Invention Steel |
| 41 | | | | | | | | 786 | Comparative Steel |
| 42 | | | | | | | | 799 | Comparative Steel |
| 43 | | | | | | | | 798 | Invention Steel |
| 44 | | | | | | | | 789 | Invention Steel |
| 45 | | | | | | | | 780 | Invention Steel |
| 46 | | | | | | | | 798 | Comparative Steel |
| 47 | | | | | | | | 800 | Invention Steel |
| 48 | | | | | | | | 788 | Invention Steel |
| 49 | | | | | | | | 800 | Invention Steel |
| 50 | | | | | | | | 806 | Comparative Steel |
| 51 | | | 0.01 | | | | | 801 | Invention Steel |
| 52 | | | 0.48 | | | | | 797 | Invention Steel |
| 53 | 0.45 | | | | | | | 807 | Invention Steel |
| 54 | 0.90 | | | | | | | 815 | Invention Steel |
| 55 | | 0.050 | | | | | | 802 | Invention Steel |
| 56 | | 0.090 | | | | | | 799 | Invention Steel |
| 57 | | | | | | | | 801 | Invention Steel |
| 58 | | | | | | | | 798 | Invention Steel |
| 59 | | | | | | 0.0050 | | 799 | Invention Steel |
| 60 | | | | | 0.0040 | | | 799 | Invention Steel |

Underline means outside the range specified in the present invention.

TABLE 3

| Steel | Chemical composition (mass %) of steel sheet for hot stamping, remainder consisting of Fe and impurities | | | | | | | | | | |
|---|---|---|---|---|---|---|---|---|---|---|---|
| No. | C | Si | Mn | Sol. Al | Ti | Cr | B | P | S | N | Nb |
| 61 | 0.46 | 0.21 | 0.48 | 0.038 | 0.023 | 0.29 | 0.0022 | 0.010 | 0.0012 | 0.0026 | |
| 62 | 0.45 | 0.15 | 0.49 | 0.045 | 0.030 | 0.26 | 0.0030 | 0.005 | 0.0014 | 0.0022 | |
| 63 | 0.70 | 1.00 | 0.45 | 0.100 | 0.021 | 0.35 | 0.0015 | 0.010 | 0.0002 | 0.0015 | |
| 64 | 0.31 | 0.20 | 1.30 | 0.030 | 0.030 | 0.20 | 0.0020 | 0.011 | 0.0007 | 0.0026 | |
| 65 | 0.46 | 0.43 | 0.41 | 0.030 | 0.028 | 0.27 | 0.0021 | 0.007 | 0.0003 | 0.0030 | 0.020 |
| 66 | 0.46 | 0.21 | 0.42 | 0.043 | 0.025 | 0.21 | 0.0020 | 0.010 | 0.0007 | 0.0027 | 0.049 |
| 67 | 0.47 | 0.35 | 0.60 | 0.020 | 0.024 | 0.31 | 0.0020 | 0.010 | 0.0007 | 0.0020 | 0.020 |
| 68 | 0.46 | 0.36 | 0.80 | 0.035 | 0.019 | 0.24 | 0.0015 | 0.010 | 0.0004 | 0.0025 | 0.020 |
| 69 | 0.46 | 0.36 | 1.00 | 0.030 | 0.028 | 0.30 | 0.0021 | 0.011 | 0.0006 | 0.0043 | 0.021 |
| 70 | 0.46 | 0.40 | 1.40 | 0.030 | 0.021 | 0.20 | 0.0015 | 0.018 | 0.0003 | 0.0013 | 0.020 |
| 71 | 0.46 | 1.25 | 0.69 | 0.016 | 0.010 | 0.42 | 0.0006 | 0.016 | 0.0330 | 0.0024 | 0.055 |

| Steel | Chemical composition (mass %) of steel sheet for hot stamping, remainder consisting of Fe and impurities | | | | | | | $Ac_3$ | |
|---|---|---|---|---|---|---|---|---|---|
| No. | Mo | V | Ni | REM | Mg | Ca | Co | (° C.) | Note |
| 61 | | | | 0.0080 | | | | 799 | Invention Steel |
| 62 | | | | | | | 4.00 | 799 | Invention Steel |
| 63 | | | | | | | | 768 | Invention Steel |
| 64 | | | | | | | | 817 | Comparative Steel |
| 65 | 0.19 | | | | | | | 810 | Invention Steel |
| 66 | 0.20 | | | | | | | 804 | Invention Steel |

TABLE 3-continued

| | | | |
|---|---|---|---|
| 67 | 0.25 | 802 | Invention Steel |
| 68 | 0.20 | 800 | Invention Steel |
| 69 | 0.30 | 798 | Invention Steel |
| 70 | 0.10 | 789 | Invention Steel |
| 71 | 0.49 | 833 | Comparative Steel |

Underline means outside the range specified in the present invention.

TABLE 4

| | | | First heat treatment | | | | | | | Second heat treatment |
|---|---|---|---|---|---|---|---|---|---|---|
| | | | | | | | Cooling 1 | | Cooling 2 | |
| Test No. | Steel No. | Plating | Average heating rate (° C./s) | $Ac_3$ (° C.) | Heating temperature T1 (° C.) | Retention time (s) | Average cooling rate (° C./s) | Cooling stop temperature (° C.) | Average cooling rate (° C./s) | Average heating rate (° C./s) |
| 1 | 1 | Absent | 5 | 742 | 730 | 120 | 15 | 250 | 5 | 50 |
| 2 | 2 | Absent | 4 | 799 | 970 | 300 | 30 | 180 | 7 | 50 |
| 3 | 3 | Absent | 5 | 742 | 900 | 240 | 40 | 450 | 5 | 20 |
| 4 | 4 | Absent | 4 | 820 | 950 | 118 | 78 | 290 | 5 | 43 |
| 5 | 5 | Absent | 12 | 795 | 940 | 137 | 30 | 270 | 6 | 41 |
| 6 | 6 | Absent | 6 | 781 | 940 | 169 | 38 | 260 | 7 | 49 |
| 7 | 7 | Absent | 4 | 754 | 940 | 300 | 32 | 250 | 6 | 51 |
| 8 | 8 | Absent | 9 | 745 | 900 | 139 | 60 | 250 | 5 | 100 |
| 9 | 9 | Absent | 6 | 795 | 900 | 223 | 74 | 300 | 6 | 48 |
| 10 | 10 | Present | 4 | 786 | 950 | 149 | 30 | 280 | 7 | 59 |
| 11 | 11 | Absent | 5 | 818 | 950 | 151 | 39 | 280 | 7 | 31 |
| 12 | 12 | Absent | 8 | 836 | 950 | 102 | 40 | 290 | 8 | 47 |
| 13 | 13 | Absent | 15 | 814 | 950 | 155 | 34 | 250 | 8 | 500 |
| 14 | 14 | Absent | 7 | 816 | 900 | 198 | 36 | 280 | 5 | 45 |
| 15 | 15 | Absent | 4 | 803 | 950 | 126 | 67 | 360 | 6 | 41 |
| 16 | 16 | Absent | 8 | 771 | 950 | 300 | 60 | 250 | 4 | 100 |
| 17 | 17 | Absent | 10 | 757 | 950 | 600 | 15 | 250 | 3 | 58 |
| 18 | 18 | Absent | 10 | 749 | 940 | 250 | 42 | 250 | 5 | 42 |
| 19 | 19 | Absent | 5 | 795 | 950 | 197 | 50 | 270 | 5 | 46 |
| 20 | 20 | Present | 4 | 799 | 950 | 241 | 43 | 280 | 6 | 57 |
| 21 | 21 | Absent | 14 | 804 | 950 | 150 | 70 | 280 | 6 | 52 |
| 22 | 22 | Absent | 7 | 808 | 950 | 212 | 34 | 280 | 6 | 31 |
| 23 | 23 | Absent | 14 | 806 | 960 | 160 | 70 | 290 | 5 | 53 |
| 24 | 24 | Absent | 4 | 805 | 950 | 160 | 70 | 290 | 6 | 48 |
| 25 | 25 | Absent | 14 | 797 | 950 | 192 | 50 | 310 | 6 | 58 |

| | Second heat treatment | | | | Hot stamping | | |
|---|---|---|---|---|---|---|---|
| Test No. | $Ac_3'$ (° C.) | Heating temperature T2 (° C.) | Retention time (s) | T2 - cooling stop temperature (° C.) | Cooling 3 Average cooling rate (° C./s) | Annealing | Note |
| 1 | 715 | 850 | 30 | 600 | 45 | Absent | Comparative Example |
| 2 | 795 | 840 | 35 | 660 | 50 | Absent | Comparative Example |
| 3 | 740 | 820 | 30 | 370 | 40 | Absent | Comparative Example |
| 4 | 784 | 800 | 30 | 510 | 60 | Absent | Comparative Example |
| 5 | 770 | 790 | 30 | 520 | 50 | Absent | Invention Example |
| 6 | 763 | 800 | 30 | 540 | 50 | Absent | Invention Example |
| 7 | 745 | 820 | 30 | 570 | 50 | Absent | Invention Example |
| 8 | 738 | 800 | 40 | 550 | 50 | Absent | Comparative Example |
| 9 | 789 | 850 | 30 | 550 | 60 | Absent | Comparative Example |
| 10 | 777 | 820 | 30 | 540 | 50 | Absent | Invention Example |
| 11 | 800 | 830 | 30 | 550 | 60 | Absent | Invention Example |
| 12 | 820 | 850 | 20 | 560 | 60 | Absent | Invention Example |
| 13 | 815 | 840 | 30 | 590 | 50 | Absent | Comparative Example |
| 14 | 805 | 830 | 40 | 550 | 100 | Absent | Comparative Example |
| 15 | 785 | 810 | 30 | 450 | 450 | Absent | Invention Example |

TABLE 4-continued

| | | | | | | | |
|---|---|---|---|---|---|---|---|
| 16 | 760 | 790 | 30 | 540 | 50 | Present | Invention Example |
| 17 | 750 | 810 | 30 | 560 | 50 | Absent | Invention Example |
| 18 | 740 | 800 | 30 | 550 | 50 | Present | Comparative Example |
| 19 | 779 | 810 | 30 | 540 | 60 | Absent | Invention Example |
| 20 | 782 | 820 | 30 | 540 | 60 | Absent | Invention Example |
| 21 | 786 | 820 | 30 | 540 | 60 | Absent | Invention Example |
| 22 | 790 | 820 | 30 | 540 | 60 | Absent | Comparative Example |
| 23 | 782 | 820 | 30 | 530 | 60 | Absent | Invention Example |
| 24 | 785 | 820 | 30 | 530 | 60 | Absent | Invention Example |
| 25 | 779 | 820 | 30 | 510 | 60 | Absent | Invention Example |

Underline means outside the range specified in the present invention or outside the manufacturing conditions recommended in the present invention.

TABLE 5

| | | | First heat treatment | | | | | | | Second heat treatment |
|---|---|---|---|---|---|---|---|---|---|---|
| | | | | | | | Cooling 1 | | Cooling 2 | |
| Test No. | Steel No. | Plating | Average heating rate (° C./s) | $Ac_3$ (° C.) | Heating temperature T1 (° C.) | Retention time (s) | Average cooling rate (° C./s) | Cooling stop temperature (° C.) | Average cooling rate (° C./s) | Average heating rate (° C./s) |
| 26 | 26 | Absent | 12 | 808 | 950 | 169 | 75 | 290 | 6 | 70 |
| 27 | 27 | Absent | 5 | 801 | 950 | 135 | 80 | 290 | 5 | 50 |
| 28 | 28 | Absent | 11 | 792 | 950 | 279 | 50 | 290 | 7 | 41 |
| 29 | 29 | Absent | 6 | 801 | 950 | 231 | 53 | 280 | 6 | 31 |
| 30 | 30 | Absent | 4 | 799 | 950 | 295 | 50 | 300 | 5 | 60 |
| 31 | 31 | Absent | 7 | 802 | 960 | 164 | 65 | 290 | 6 | 49 |
| 32 | 32 | Absent | 11 | 802 | 950 | 283 | 50 | 280 | 6 | 32 |
| 33 | 33 | Absent | 8 | 804 | 950 | 250 | 50 | 290 | 5 | 43 |
| 34 | 34 | Absent | 10 | 801 | 950 | 177 | 80 | 290 | 5 | 60 |
| 35 | 35 | Absent | 12 | 792 | 950 | 297 | 72 | 280 | 7 | 56 |
| 36 | 36 | Absent | 8 | 778 | 950 | 200 | 34 | 290 | 8 | 36 |
| 37 | 37 | Absent | 12 | 808 | 950 | 205 | 76 | 290 | 5 | 200 |
| 38 | 38 | Absent | 8 | 795 | 950 | 165 | 70 | 290 | 8 | 60 |
| 39 | 39 | Absent | 8 | 799 | 950 | 240 | 60 | 290 | 6 | 51 |
| 40 | 40 | Absent | 4 | 800 | 950 | 235 | 44 | 270 | 8 | 100 |
| 41 | 41 | Absent | 13 | 786 | 950 | 232 | 50 | 280 | 8 | 50 |
| 42 | 42 | Absent | 9 | 799 | 950 | 241 | 29 | 300 | 7 | 45 |
| 43 | 43 | Absent | 11 | 798 | 940 | 185 | 26 | 290 | 6 | 42 |
| 44 | 44 | Absent | 5 | 789 | 950 | 157 | 64 | 300 | 7 | 43 |
| 45 | 45 | Absent | 13 | 780 | 970 | 400 | 50 | 270 | 5 | 300 |
| 46 | 46 | Absent | 11 | 798 | 950 | 180 | 50 | 290 | 7 | 65 |
| 47 | 47 | Absent | 10 | 800 | 950 | 205 | 60 | 290 | 7 | 60 |
| 48 | 48 | Absent | 5 | 788 | 960 | 250 | 65 | 300 | 6 | 50 |
| 49 | 49 | Absent | 10 | 800 | 950 | 270 | 76 | 300 | 4 | 70 |
| 50 | 50 | Absent | 13 | 806 | 950 | 200 | 60 | 280 | 5 | 50 |

| | Second heat treatment | | | | Hot | | |
|---|---|---|---|---|---|---|---|
| Test No. | $Ac_3'$ (° C.) | Heating temperature T2 (° C.) | Retention time (s) | T2 - cooling stop temperature (° C.) | stamping Cooling 3 Average cooling rate (° C./s) | Annealing | Note |
| 26 | 786 | 820 | 30 | 530 | 60 | Absent | Comparative Example |
| 27 | 794 | 870 | 30 | 580 | 60 | Absent | Comparative Example |
| 28 | 775 | 810 | 30 | 520 | 50 | Absent | Invention Example |
| 29 | 790 | 820 | 30 | 540 | 60 | Absent | Invention Example |
| 30 | 782 | 820 | 30 | 520 | 60 | Absent | Invention Example |
| 31 | 785 | 820 | 30 | 530 | 80 | Absent | Comparative Example |
| 32 | 788 | 820 | 30 | 540 | 80 | Absent | Comparative Example |
| 33 | 780 | 820 | 30 | 530 | 80 | Absent | Invention Example |
| 34 | 774 | 820 | 30 | 530 | 80 | Absent | Invention Example |
| 35 | 783 | 820 | 30 | 540 | 60 | Absent | Invention Example |
| 36 | 770 | 820 | 30 | 530 | 50 | Absent | Comparative Example |
| 37 | 803 | 840 | 30 | 550 | 20 | Absent | Comparative Example |
| 38 | 786 | 820 | 30 | 530 | 60 | Absent | Invention Example |
| 39 | 780 | 820 | 30 | 530 | 80 | Absent | Invention Example |
| 40 | 773 | 810 | 30 | 540 | 50 | Absent | Invention Example |
| 41 | 772 | 820 | 30 | 540 | 50 | Absent | Comparative Example |
| 42 | 787 | 810 | 30 | 510 | 60 | Absent | Comparative Example |
| 43 | 790 | 820 | 30 | 530 | 60 | Present | Invention Example |
| 44 | 771 | 820 | 30 | 520 | 60 | Absent | Invention Example |
| 45 | 765 | 800 | 30 | 530 | 15 | Absent | Invention Example |

TABLE 5-continued

| | | | | | | | |
|---|---|---|---|---|---|---|---|
| 46 | 780 | 810 | 30 | 520 | 70 | Absent | Comparative Example |
| 47 | 788 | 820 | 30 | 530 | 70 | Absent | Invention Example |
| 48 | 770 | 810 | 30 | 510 | 70 | Absent | Invention Example |
| 49 | 781 | 810 | 30 | 510 | 70 | Absent | Invention Example |
| 50 | 793 | 820 | 30 | 540 | 70 | Absent | Comparative Example |

Underline means outside the range specified in the present invention or outside the manufacturing conditions recommended in the present invention.

TABLE 6

| | | | First heat treatment | | | | | | | |
|---|---|---|---|---|---|---|---|---|---|---|
| | | | | | | | Cooling 1 | | Cooling 2 | Second heat treatment |
| Test No. | Steel No. | Plating | Average heating rate (° C./s) | $Ac_3$ (° C.) | Heating temperature T1 (° C.) | Retention time (s) | Average cooling rate (° C./s) | Cooling stop temperature (° C.) | Average cooling rate (° C./s) | Average heating rate (° C./s) |
| 51 | 51 | Absent | 4 | 801 | 950 | 250 | 70 | 290 | 6 | 32 |
| 52 | 52 | Absent | 6 | 797 | 950 | 150 | 30 | 300 | 7 | 50 |
| 53 | 53 | Absent | 8 | 807 | 960 | 182 | 70 | 260 | 7 | 50 |
| 54 | 54 | Absent | 4 | 815 | 950 | 250 | 60 | 320 | 5 | 70 |
| 55 | 55 | Present | 12 | 802 | 960 | 243 | 60 | 300 | 5 | 56 |
| 56 | 56 | Absent | 8 | 799 | 950 | 200 | 70 | 290 | 6 | 42 |
| 57 | 57 | Absent | 14 | 801 | 930 | 191 | 70 | 300 | 5 | 100 |
| 58 | 58 | Absent | 5 | 798 | 940 | 240 | 50 | 290 | 6 | 12 |
| 59 | 59 | Absent | 6 | 799 | 970 | 200 | 50 | 300 | 4 | 975 |
| 60 | 60 | Absent | 5 | 799 | 990 | 185 | 72 | 300 | 7 | 200 |
| 61 | 61 | Absent | 14 | 799 | 950 | 200 | 480 | 290 | 8 | 20 |
| 62 | 62 | Absent | 10 | 799 | 805 | 300 | 250 | 370 | 4 | 54 |
| 63 | 16 | Absent | 5 | 771 | 760 | 240 | 70 | 260 | 5 | 100 |
| 64 | 16 | Absent | 5 | 771 | 1000 | 240 | 70 | 260 | 5 | 20 |
| 65 | 16 | Absent | 5 | 771 | 900 | 120 | 5 | 260 | 5 | 100 |
| 66 | 16 | Absent | 5 | 771 | 900 | 120 | 1000 | 250 | 5 | — |
| 67 | 16 | Absent | 5 | 771 | 900 | 120 | 70 | 200 | 5 | 100 |
| 68 | 16 | Absent | 5 | 771 | 900 | 140 | 60 | 500 | 5 | 100 |
| 69 | 16 | Absent | 5 | 771 | 920 | 200 | 60 | 260 | 15 | 20 |
| 70 | 16 | Absent | 5 | 771 | 950 | 200 | 60 | 270 | 4 | 5 |
| 71 | 16 | Absent | 5 | 771 | 920 | 240 | 60 | 270 | 5 | 1100 |
| 72 | 16 | Absent | 5 | 771 | 920 | 240 | 60 | 280 | 4 | 50 |
| 73 | 16 | Absent | 5 | 771 | 920 | 240 | 60 | 260 | 5 | 50 |
| 74 | 63 | Absent | 5 | 768 | 930 | 290 | 55 | 250 | 3 | 50 |
| 75 | 64 | Absent | 5 | 817 | 930 | 240 | 80 | 300 | 5 | 45 |

| | Second heat treatment | | | | Hot stamping | | |
|---|---|---|---|---|---|---|---|
| Test No. | $Ac_3'$ (° C.) | Heating temperature T2 (° C.) | Retention time (s) | T2 - cooling stop temperature (° C.) | Cooling 3 Average cooling rate (° C./s) | Annealing | Note |
| 51 | 788 | 820 | 30 | 530 | 60 | Absent | Invention Example |
| 52 | 780 | 820 | 30 | 520 | 70 | Absent | Invention Example |
| 53 | 800 | 830 | 30 | 570 | 70 | Absent | Invention Example |
| 54 | 797 | 820 | 30 | 500 | 60 | Absent | Invention Example |
| 55 | 785 | 820 | 30 | 520 | 60 | Present | Invention Example |
| 56 | 787 | 820 | 30 | 530 | 60 | Absent | Invention Example |
| 57 | 780 | 810 | 30 | 510 | 70 | Absent | Invention Example |
| 58 | 783 | 820 | 30 | 530 | 70 | Absent | Invention Example |
| 59 | 778 | 810 | 20 | 510 | 100 | Absent | Invention Example |
| 60 | 788 | 840 | 30 | 540 | 60 | Absent | Invention Example |
| 61 | 790 | 820 | 30 | 530 | 60 | Absent | Invention Example |
| 62 | 774 | 830 | 30 | 460 | 480 | Absent | Invention Example |
| 63 | 766 | 820 | 40 | 560 | 50 | Absent | Comparative Example |
| 64 | 764 | 840 | 30 | 580 | 50 | Absent | Comparative Example |
| 65 | 765 | 830 | 30 | 570 | 50 | Absent | Comparative Example |
| 66 | | | — | | | Absent | Comparative Example |
| 67 | 769 | 810 | 30 | 610 | 50 | Absent | Comparative Example |
| 68 | 770 | 820 | 30 | 320 | 60 | Absent | Comparative Example |
| 69 | 769 | 830 | 30 | 570 | 60 | Absent | Comparative Example |
| 70 | 765 | 820 | 30 | 550 | 60 | Absent | Comparative Example |

TABLE 6-continued

| | | | | | | | |
|---|---|---|---|---|---|---|---|
| 71 | 767 | 830 | 30 | 560 | 60 | Absent | Comparative Example |
| 72 | 763 | 740 | 20 | 460 | 60 | Absent | Comparative Example |
| 73 | 765 | 950 | 40 | 690 | 60 | Absent | Comparative Example |
| 74 | 760 | 930 | 30 | 680 | 60 | Absent | Comparative Example |
| 75 | 780 | 850 | 30 | 550 | 60 | Absent | Comparative Example |

Underline means outside the range specified in the present invention or outside the manufacturing conditions recommended in the present invention.

TABLE 7

| | | | First heat treatment | | | | | | | |
|---|---|---|---|---|---|---|---|---|---|---|
| | | | | | | | Cooling 1 | | Cooling 2 | Second heat treatment |
| Test No. | Steel No. | Plating | Average heating rate (° C./s) | $Ac_3$ (° C.) | Heating temperature T1 (° C.) | Retention time (s) | Average cooling rate (° C./s) | Cooling stop temperature (° C.) | Average cooling rate (° C./s) | Average heating rate (° C./s) |
| 76 | 65 | Absent | 10 | 811 | 930 | 210 | 50 | 310 | 5 | 75 |
| 77 | 66 | Absent | 15 | 805 | 930 | 200 | 50 | 300 | 5 | 80 |
| 78 | 67 | Absent | 10 | 802 | 940 | 200 | 40 | 310 | 5 | 50 |
| 79 | 68 | Absent | 11 | 800 | 950 | 280 | 60 | 300 | 6 | 40 |
| 80 | 69 | Absent | 10 | 798 | 950 | 250 | 40 | 305 | 5 | 50 |
| 81 | 70 | Absent | 10 | 789 | 950 | 240 | 40 | 280 | 6 | 90 |
| 82 | 70 | Absent | 10 | 789 | 950 | 240 | 50 | 230 | 6 | 80 |
| 83 | 45 | Absent | 15 | 780 | 970 | 400 | 50 | 236 | 5 | 300 |
| 84 | 40 | Absent | 5 | 800 | 950 | 235 | 45 | 210 | 8 | 100 |
| 85 | 70 | Absent | 10 | 789 | 950 | 240 | 50 | 407 | 5 | 80 |
| 86 | 45 | Absent | 15 | 780 | 950 | 400 | 50 | 410 | 5 | 50 |
| 87 | 65 | Absent | 10 | 811 | 930 | 210 | 50 | 326 | 5 | 75 |
| 88 | 65 | Absent | 10 | 811 | 930 | 210 | 50 | 345 | 5 | 75 |
| 89 | 21 | Absent | 15 | 804 | 950 | 150 | 70 | 350 | 6 | 50 |
| 90 | 5 | Absent | 12 | 795 | 940 | 140 | 30 | 265 | 6 | 45 |
| 91 | 16 | Absent | 8 | 771 | 950 | 300 | 60 | 250 | 5 | 100 |
| 92 | 44 | Absent | 5 | 789 | 950 | 160 | 60 | 265 | 7 | 45 |
| 93 | 44 | Absent | 5 | 789 | 950 | 160 | 60 | 260 | 6 | 50 |
| 94 | 44 | Absent | 5 | 789 | 950 | 160 | 60 | 270 | 7 | 45 |
| 95 | 40 | Absent | 4 | 800 | 950 | 240 | 45 | 270 | 8 | 100 |
| 96 | 2 | Absent | 4 | 799 | 970 | 300 | 40 | 290 | 5 | 45 |
| 97 | 5 | Absent | 12 | 795 | 940 | 140 | 40 | 270 | 7 | 45 |
| 98 | 7 | Absent | 4 | 754 | 940 | 300 | 35 | 270 | 6 | 30 |
| 99 | 24 | Absent | 4 | 805 | 950 | 160 | 70 | 290 | 7 | 48 |
| 100 | 47 | Absent | 10 | 800 | 950 | 205 | 60 | 280 | 6 | 60 |

| | Second heat treatment | | | | Hot stamping | | |
|---|---|---|---|---|---|---|---|
| Test No. | $Ac_3'$ (° C.) | Heating temperature T2 (° C.) | Retention time (s) | T2 - cooling stop temperature (° C.) | Cooling 3 Average cooling rate (° C./s) | Annealing | Note |
| 76 | 782 | 820 | 30 | 510 | 60 | Absent | Invention Example |
| 77 | 784 | 820 | 30 | 520 | 70 | Absent | Invention Example |
| 78 | 793 | 820 | 30 | 510 | 60 | Absent | Invention Example |
| 79 | 773 | 820 | 30 | 520 | 60 | Absent | Invention Example |
| 80 | 779 | 820 | 30 | 515 | 50 | Absent | Invention Example |
| 81 | 769 | 810 | 30 | 530 | 50 | Absent | Invention Example |
| 82 | 775 | 820 | 30 | 590 | 60 | Absent | Comparative Example |
| 83 | 771 | 810 | 30 | 574 | 15 | Absent | Comparative Example |
| 84 | 786 | 830 | 30 | 620 | 60 | Absent | Comparative Example |
| 85 | 770 | 820 | 40 | 413 | 50 | Absent | Comparative Example |
| 86 | 769 | 820 | 40 | 410 | 15 | Absent | Comparative Example |
| 87 | 779 | 820 | 30 | 494 | 60 | Absent | Invention Example |
| 88 | 776 | 820 | 30 | 475 | 60 | Absent | Invention Example |
| 89 | 783 | 820 | 30 | 470 | 60 | Absent | Invention Example |
| 90 | 772 | 871 | 30 | 606 | 50 | Absent | Comparative Example |
| 91 | 759 | 855 | 30 | 605 | 50 | Absent | Comparative Example |
| 92 | 776 | 875 | 30 | 610 | 60 | Absent | Comparative Example |
| 93 | 777 | 875 | 30 | 615 | 60 | Absent | Comparative Example |
| 94 | 771 | 830 | 8 | 560 | 60 | Absent | Comparative Example |
| 95 | 775 | 810 | 5 | 540 | 50 | Absent | Comparative Example |

TABLE 7-continued

| | | | | | | | |
|---|---|---|---|---|---|---|---|
| 96 | 786 | 820 | 1 | 530 | 50 | Absent | Comparative Example |
| 97 | 770 | 790 | 9 | 520 | 50 | Absent | Comparative Example |
| 98 | 745 | 840 | 65 | 570 | 50 | Absent | Comparative Example |
| 99 | 787 | 840 | 70 | 550 | 60 | Absent | Comparative Example |
| 100 | 789 | 830 | 100 | 550 | 50 | Absent | Comparative Example |

Underline means outside the range specified in the present invention or outside the manufacturing conditions recommended in the present invention.

TABLE 8

| | | | First heat treatment | | | | | | | Second heat treatment |
|---|---|---|---|---|---|---|---|---|---|---|
| | | | | | | | Cooling 1 | | Cooling 2 | |
| Test No. | Steel No. | Plating | Average heating rate (° C./s) | $Ac_3$ (° C.) | Heating temperature T1 (° C.) | Retention time (s) | Average cooling rate (° C./s) | Cooling stop temperature (° C.) | Average cooling rate (° C./s) | Average heating rate (° C./s) |
| 101 | 5 | Absent | 12 | 795 | 940 | 140 | 40 | 270 | 6 | 45 |
| 102 | 66 | Absent | 15 | 805 | 930 | 200 | 50 | 300 | 5 | 80 |
| 103 | 44 | Absent | 5 | 789 | 950 | 160 | 65 | 300 | 6 | 45 |
| 104 | 16 | Absent | 8 | 771 | 950 | 300 | 60 | 270 | 4 | 105 |
| 105 | 53 | Absent | 8 | 807 | 960 | 190 | 70 | 300 | 7 | 50 |
| 106 | 10 | Present | 4 | 786 | 950 | 150 | 30 | 280 | 7 | 59 |
| 107 | 21 | Absent | 15 | 804 | 950 | 150 | 70 | 280 | 6 | 52 |
| 108 | 68 | Absent | 11 | 800 | 950 | 280 | 60 | 300 | 6 | 40 |
| 109 | 44 | Absent | 5 | 789 | 950 | 160 | 65 | 300 | 7 | 43 |
| 110 | 69 | Absent | 10 | 798 | 950 | 250 | 40 | 305 | 5 | 50 |
| 111 | 44 | Absent | 5 | 789 | 950 | 160 | 64 | 275 | 7 | 43 |
| 112 | 71 | Absent | 10 | 833 | 950 | 120 | 40 | 300 | 7 | 50 |
| 113 | 71 | Absent | 30 | 833 | 900 | 10 | 50 | 250 | 9 | 1000 |
| 114 | 71 | Absent | 30 | 833 | 900 | 10 | 50 | 250 | 8 | 1000 |
| 115 | 71 | Absent | 30 | 833 | 900 | 10 | 50 | 260 | 8 | 1000 |
| 116 | 71 | Absent | 30 | 833 | 900 | 10 | 50 | 260 | 8 | 1000 |

| | Second heat treatment | | | | Hot stamping | | |
|---|---|---|---|---|---|---|---|
| Test No. | $Ac_3'$ (° C.) | Heating temperature T2 (° C.) | Retention time (s) | T2 - cooling stop temperature (° C.) | Cooling 3 Average cooling rate (° C./s) | Annealing | Note |
| 101 | 770 | 860 | 300 | 590 | 50 | Absent | Comparative Example |
| 102 | 753 | 820 | 20 | 520 | 70 | Absent | Invention Example |
| 103 | 771 | 820 | 25 | 520 | 60 | Absent | Invention Example |
| 104 | 760 | 790 | 20 | 520 | 50 | Present | Invention Example |
| 105 | 800 | 830 | 20 | 530 | 70 | Absent | Invention Example |
| 106 | 778 | 820 | 45 | 540 | 50 | Absent | Invention Example |
| 107 | 786 | 820 | 55 | 540 | 60 | Absent | Invention Example |
| 108 | 772 | 820 | 50 | 520 | 60 | Absent | Invention Example |
| 109 | 771 | 820 | 12 | 520 | 60 | Absent | Invention Example |
| 110 | 779 | 820 | 15 | 515 | 50 | Absent | Invention Example |
| 111 | 771 | 860 | 30 | 585 | 60 | Absent | Invention Example |
| 112 | 805 | 850 | 30 | 550 | 60 | Absent | Comparative Example |
| 113 | 810 | 850 | 0.1 | 600 | 100 | Absent | Comparative Example |
| 114 | 810 | 870 | 30 | 620 | 60 | Absent | Comparative Example |
| 115 | 809 | 850 | 10 | 590 | 60 | Absent | Comparative Example |
| 116 | 809 | 850 | 65 | 590 | 60 | Absent | Comparative Example |

Underline means outside the range specified in the present invention or outside the manufacturing conditions recommended in the present invention.

TABLE 9

| | | Steel sheet for hot stamping | | | | | Hot-stamping formed body | | | |
|---|---|---|---|---|---|---|---|---|---|---|
| | | | Proportion of high angle grain boundaries | Microstructure | | Density of carbides having circle equivalent diameter of 0.20 μm or more | Microstructure | | | Average grain size of prior γ |
| Test No. | Steel No. | Plating | (%) | Residual austenite (area %) | Others (area %) | (/μm$^2$) | Martensite (area %) | Others (area %) | Total (area %) | (μm) |
| 1 | 1 | Absent | 30 | 5 | 6 | 0.2 | 98 | 2 | 100 | 3.3 |
| 2 | 2 | Absent | 50 | 0 | 1 | 0.4 | 100 | 0 | 100 | 5.0 |
| 3 | 3 | Absent | 47 | 0 | 1 | 1.0 | 100 | 0 | 100 | 8.9 |
| 4 | 4 | Absent | 33 | 3 | 5 | 0.3 | 100 | 0 | 100 | 4.1 |
| 5 | 5 | Absent | 40 | 4 | 0 | 0.4 | 100 | 0 | 100 | 3.5 |
| 6 | 6 | Absent | 53 | 3 | 0 | 0.2 | 100 | 0 | 100 | 3.6 |
| 7 | 7 | Absent | 60 | 4 | 1 | 0.3 | 100 | 0 | 100 | 4.5 |
| 8 | 8 | Absent | 59 | 2 | 1 | 1.2 | 100 | 0 | 100 | 3.0 |
| 9 | 9 | Absent | 42 | 1 | 0 | 0.9 | 100 | 0 | 100 | 4.8 |
| 10 | 10 | Present | 46 | 3 | 1 | 0.4 | 100 | 0 | 100 | 4.2 |
| 11 | 11 | Absent | 44 | 5 | 0 | 0.2 | 100 | 0 | 100 | 4.5 |
| 12 | 12 | Absent | 45 | 8 | 0 | 0.1 | 100 | 0 | 100 | 4.7 |
| 13 | 13 | Absent | 49 | 0 | 2 | 0.2 | 100 | 0 | 100 | 3.5 |
| 14 | 14 | Absent | 35 | 1 | 4 | 0.4 | 98 | 2 | 100 | 4.9 |
| 15 | 15 | Absent | 45 | 3 | 1 | 0.2 | 100 | 0 | 100 | 3.7 |
| 16 | 16 | Absent | 50 | 4 | 0 | 0.2 | 100 | 0 | 100 | 3.2 |
| 17 | 17 | Absent | 47 | 4 | 0 | 0.1 | 100 | 0 | 100 | 3.4 |
| 18 | 18 | Absent | 47 | 3 | 1 | 0.2 | 100 | 0 | 100 | 2.9 |
| 19 | 19 | Absent | 43 | 2 | 2 | 0.2 | 100 | 0 | 100 | 3.8 |
| 20 | 20 | Present | 41 | 1 | 1 | 0.2 | 100 | 0 | 100 | 4.5 |
| 21 | 21 | Absent | 44 | 3 | 0 | 0.3 | 100 | 0 | 100 | 4.2 |
| 22 | 22 | Absent | 42 | 2 | 1 | 0.3 | 100 | 0 | 100 | 4.6 |
| 23 | 23 | Absent | 43 | 3 | 0 | 0.2 | 100 | 0 | 100 | 4.1 |
| 24 | 24 | Absent | 43 | 2 | 2 | 0.3 | 100 | 0 | 100 | 4.3 |
| 25 | 25 | Absent | 42 | 3 | 0 | 0.2 | 100 | 0 | 100 | 4.0 |

| | Hot-stamping formed body | | | Mechanical properties | | | | |
|---|---|---|---|---|---|---|---|---|
| Test No. | Average Mn concentration of prior γ grain boundaries (mass %) | Density of carbides having circle equivalent diameter of 0.20 μm or more (/μm$^2$) | Partially softened region | Tensile strength (MPa) | Average hardness (Hv) | Early fracture evaluation | Hardness variation ΔHv (Hv) | Note |
| 1 | 1.3 | 0.2 | Absent | 900 | 880 | 0.31 | 60 | Comparative Example |
| 2 | 1.5 | 0.3 | Absent | 1,304 | 670 | 0.59 | 51 | Comparative Example |
| 3 | 2.0 | 0.3 | Absent | 677 | 855 | 0.24 | 63 | Comparative Example |
| 4 | 0.5 | 0.1 | Absent | 1,888 | 596 | 0.96 | 15 | Comparative Example |
| 5 | 0.9 | 0.2 | Absent | 2,008 | 676 | 0.90 | 23 | Invention Example |
| 6 | 0.3 | 0.1 | Absent | 2,219 | 810 | 0.83 | 47 | Invention Example |
| 7 | 0.2 | 0 | Absent | 2,371 | 971 | 0.74 | 48 | Invention Example |
| 8 | 0.3 | 1.0 | Absent | 1,637 | 992 | 0.50 | 49 | Comparative Example |
| 9 | 0.5 | 0.8 | Absent | 1,396 | 717 | 0.59 | 25 | Comparative Example |
| 10 | 0.6 | 0.2 | Absent | 2,335 | 737 | 0.96 | 26 | Invention Example |
| 11 | 0.4 | 0 | Absent | 2,321 | 725 | 0.97 | 22 | Invention Example |
| 12 | 0.4 | 0 | Absent | 2,337 | 730 | 0.97 | 21 | Invention Example |
| 13 | 1.2 | 0.1 | Absent | 1,236 | 780 | 0.48 | 57 | Comparative Example |
| 14 | 0.3 | 0.2 | Absent | 1,158 | 605 | 0.58 | 13 | Comparative Example |
| 15 | 0.4 | 0.1 | Absent | 2,237 | 706 | 0.96 | 19 | Invention Example |
| 16 | 0.8 | 0.1 | Present | 2,286 | 745 | 0.93 | 30 | Invention Example |
| 17 | 0.9 | 0.1 | Absent | 2,162 | 720 | 0.91 | 23 | Invention Example |
| 18 | 1.0 | 0.1 | Present | 860 | 724 | 0.36 | 48 | Comparative Example |
| 19 | 0.3 | 0.1 | Absent | 2,323 | 711 | 0.99 | 20 | Invention Example |

TABLE 9-continued

| | | | | | | | | |
|---|---|---|---|---|---|---|---|---|
| 20 | 0.6 | 0.1 | Absent | 2,128 | 686 | 0.94 | 17 | Invention Example |
| 21 | 0.4 | 0.2 | Absent | 2,287 | 722 | 0.96 | 22 | Invention Example |
| 22 | 0.4 | 0.2 | Absent | 1,332 | 708 | 0.57 | 27 | Comparative Example |
| 23 | 0.4 | 0.1 | Absent | 2,257 | 705 | 0.97 | 21 | Invention Example |
| 24 | 0.5 | 0.2 | Absent | 2,154 | 702 | 0.93 | 23 | Invention Example |
| 25 | 0.4 | 0.2 | Absent | 2,207 | 704 | 0.95 | 25 | Invention Example |

Underline means outside the range specified in the present invention or that the target performance is not satisfied.

TABLE 10

| | | Steel sheet for hot stamping | | | | | Hot-stamping formed body | | | |
|---|---|---|---|---|---|---|---|---|---|---|
| | | | Proportion of high angle grain | Microstructure | | Density of carbides having circle equivalent diameter | Microstructure | | | Average grain |
| Test No. | Steel No. | Plating | boundaries (%) | Residual austenite (area %) | Others (area %) | of 0.20 μm or more (/μm²) | Martensite (area %) | Others (area %) | Total (area %) | size of prior γ (μm) |
| 26 | 26 | Absent | 41 | 2 | 1 | 0.3 | 100 | 0 | 100 | 4.5 |
| 27 | 27 | Absent | 43 | 3 | 0 | 0.3 | 100 | 0 | 100 | 12.3 |
| 28 | 28 | Absent | 45 | 4 | 0 | 0.2 | 100 | 0 | 100 | 3.9 |
| 29 | 29 | Absent | 44 | 3 | 1 | 0.2 | 100 | 0 | 100 | 4.3 |
| 30 | 30 | Absent | 45 | 4 | 0 | 0.1 | 100 | 0 | 100 | 3.8 |
| 31 | 31 | Absent | 46 | 3 | 1 | 0.2 | 100 | 0 | 100 | 4.1 |
| 32 | 32 | Absent | 44 | 2 | 0 | 1.0 | 100 | 0 | 100 | 4.4 |
| 33 | 33 | Absent | 44 | 3 | 0 | 0.4 | 100 | 0 | 100 | 3.8 |
| 34 | 34 | Absent | 43 | 3 | 0 | 0.2 | 100 | 0 | 100 | 3.5 |
| 35 | 35 | Absent | 46 | 5 | 0 | 0.1 | 100 | 0 | 100 | 3.7 |
| 36 | 36 | Absent | 44 | 6 | 0 | 0.1 | 100 | 0 | 100 | 4.0 |
| 37 | 37 | Absent | 37 | 2 | 8 | 0.5 | 84 | 16 | 100 | 4.8 |
| 38 | 38 | Absent | 47 | 4 | 0 | 0.3 | 100 | 0 | 100 | 3.7 |
| 39 | 39 | Absent | 42 | 3 | 0 | 0.2 | 100 | 0 | 100 | 3.5 |
| 40 | 40 | Absent | 46 | 5 | 0 | 0.1 | 100 | 0 | 100 | 2.6 |
| 41 | 41 | Absent | 42 | 4 | 1 | 0.2 | 100 | 0 | 100 | 3.7 |
| 42 | 42 | Absent | 44 | 3 | 0 | 0.3 | 100 | 0 | 100 | 4.2 |
| 43 | 43 | Absent | 43 | 2 | 1 | 0.2 | 100 | 0 | 100 | 4.6 |
| 44 | 44 | Absent | 42 | 3 | 0 | 0.2 | 100 | 0 | 100 | 3.5 |
| 45 | 45 | Absent | 46 | 6 | 0 | 0.1 | 100 | 0 | 100 | 2.6 |
| 46 | 46 | Absent | 44 | 4 | 1 | 0.2 | 100 | 0 | 100 | 4.4 |
| 47 | 47 | Absent | 42 | 2 | 0 | 0.3 | 100 | 0 | 100 | 4.6 |
| 48 | 48 | Absent | 43 | 2 | 0 | 0.3 | 100 | 0 | 100 | 3.3 |
| 49 | 49 | Absent | 42 | 3 | 0 | 0.2 | 100 | 0 | 100 | 4.1 |
| 50 | 50 | Absent | 41 | 2 | 1 | 0.2 | 100 | 0 | 100 | 4.9 |

| | Hot-stamping formed body | | | Mechanical properties | | | | |
|---|---|---|---|---|---|---|---|---|
| Test No. | Average Mn concentration of prior γ grain boundaries (mass %) | Density of carbides having circle equivalent diameter of 0.20 μm or more (/μm²) | Partially softened region | Tensile strength (MPa) | Average hardness (Hv) | Early fracture evaluation | Hardness variation ΔHv (Hv) | Note |
| 26 | 0.4 | 0.2 | Absent | 1,178 | 700 | 0.51 | 18 | Comparative Example |
| 27 | 0.5 | 0.1 | Absent | 1,275 | 690 | 0.56 | 20 | Comparative Example |
| 28 | 0.6 | 0.1 | Absent | 2,292 | 731 | 0.95 | 27 | Invention Example |
| 29 | 0.4 | 0.1 | Absent | 2,362 | 738 | 0.97 | 22 | Invention Example |
| 30 | 0.3 | 0.1 | Absent | 2,403 | 743 | 0.98 | 21 | Invention Example |
| 31 | 0.5 | 0.2 | Absent | 1,328 | 745 | 0.54 | 23 | Comparative Example |
| 32 | 0.4 | 0.6 | Absent | 1,430 | 747 | 0.58 | 24 | Comparative Example |
| 33 | 0.3 | 0.2 | Absent | 2,372 | 741 | 0.97 | 20 | Invention Example |
| 34 | 0.3 | 0.1 | Absent | 2,419 | 748 | 0.98 | 16 | Invention Example |
| 35 | 0.4 | 0 | Absent | 2,213 | 745 | 0.90 | 19 | Invention Example |
| 36 | 1.2 | 0 | Absent | 1,121 | 755 | 0.45 | 53 | Comparative Example |
| 37 | 0.5 | 0.4 | Absent | 1,104 | 587 | 0.57 | 18 | Comparative Example |
| 38 | 0.4 | 0.2 | Absent | 2,271 | 740 | 0.93 | 22 | Invention Example |

TABLE 10-continued

| | | | | | | | | |
|---|---|---|---|---|---|---|---|---|
| 39 | 0.3 | 0.1 | Absent | 2,289 | 715 | 0.97 | 17 | Invention Example |
| 40 | 0.5 | 0 | Absent | 2,053 | 732 | 0.85 | 29 | Invention Example |
| 41 | 1.1 | 0.1 | Absent | 1,409 | 736 | 0.58 | 55 | Comparative Example |
| 42 | 0.6 | 0.2 | Absent | 859 | 723 | 0.36 | 30 | Comparative Example |
| 43 | 0.5 | 0.1 | Present | 2,268 | 731 | 0.94 | 23 | Invention Example |
| 44 | 0.8 | 0.2 | Absent | 2,161 | 744 | 0.88 | 36 | Invention Example |
| 45 | 1.0 | 0 | Absent | 2,028 | 723 | 0.85 | 34 | Invention Example |
| 46 | 0.4 | 0.2 | Absent | 1,205 | 745 | 0.49 | 20 | Comparative Example |
| 47 | 0.4 | 0.2 | Absent | 2,344 | 740 | 0.96 | 18 | Invention Example |
| 48 | 0.7 | 0.2 | Absent | 2,002 | 749 | 0.81 | 32 | Invention Example |
| 49 | 0.3 | 0.1 | Absent | 2,388 | 746 | 0.97 | 19 | Invention Example |
| 50 | 0.4 | 0.2 | Absent | 1,161 | 718 | 0.49 | 21 | Comparative Example |

Underline means outside the range specified in the present invention or that the target performance is not satisfied.

TABLE 11

| | | Steel sheet for hot stamping | | | | | Hot-stamping formed body | | | |
|---|---|---|---|---|---|---|---|---|---|---|
| | | | Proportion of high angle grain boundaries (%) | Microstructure | | Density of carbides having circle equivalent diameter of 0.20 μm or more (/μm²) | Microstructure | | | Average grain size of prior γ (μm) |
| Test No. | Steel No. | Plating | | Residual austenite (area %) | Others (area %) | | Martensite (area %) | Others (area %) | Total (area %) | |
| 51 | 51 | Absent | 41 | 3 | 0 | 0.1 | 100 | 0 | 100 | 4.5 |
| 52 | 52 | Absent | 43 | 5 | 0 | 0.1 | 100 | 0 | 100 | 4.4 |
| 53 | 53 | Absent | 44 | 4 | 0 | 0.1 | 100 | 0 | 100 | 4.7 |
| 54 | 54 | Absent | 45 | 5 | 0 | 0.2 | 100 | 0 | 100 | 3.9 |
| 55 | 55 | Present | 44 | 4 | 0 | 0.1 | 100 | 0 | 100 | 4.1 |
| 56 | 56 | Absent | 46 | 4 | 0 | 0 | 100 | 0 | 100 | 3.8 |
| 57 | 57 | Absent | 48 | 4 | 0 | 0.1 | 100 | 0 | 100 | 2.5 |
| 58 | 58 | Absent | 49 | 5 | 0 | 0.2 | 100 | 0 | 100 | 3.4 |
| 59 | 59 | Absent | 41 | 3 | 1 | 0.2 | 100 | 0 | 100 | 2.5 |
| 60 | 60 | Absent | 42 | 3 | 1 | 0.2 | 100 | 0 | 100 | 3.3 |
| 61 | 61 | Absent | 44 | 3 | 0 | 0 | 100 | 0 | 100 | 4.6 |
| 62 | 62 | Absent | 39 | 2 | 4 | 0.1 | 100 | 0 | 100 | 3.5 |
| 63 | 16 | Absent | 25 | 1 | 10 | 0.5 | 89 | 11 | 100 | 4.3 |
| 64 | 16 | Absent | 40 | 2 | 0 | 0.1 | 100 | 0 | 100 | 9.0 |
| 65 | 16 | Absent | 23 | 1 | 12 | 0.4 | 100 | 0 | 100 | 7.3 |
| 66 | 16 | Absent | 57 | 3 | 0 | 0 | — | — | — | — |
| 67 | 16 | Absent | 53 | 0 | 0 | 0.1 | 100 | 0 | 100 | 5.0 |
| 68 | 16 | Absent | 46 | 0 | 2 | 1.0 | 95 | 5 | 100 | 10.4 |
| 69 | 16 | Absent | 52 | 0 | 0 | 0.1 | 100 | 0 | 100 | 9.5 |
| 70 | 16 | Absent | 49 | 5 | 0 | 0.2 | 100 | 0 | 100 | 8.7 |
| 71 | 16 | Absent | 49 | 4 | 0 | 0.2 | 100 | 0 | 100 | 6.1 |
| 72 | 16 | Absent | 49 | 5 | 0 | 0.1 | 100 | 0 | 100 | 3.1 |
| 73 | 16 | Absent | 50 | 4 | 0 | 0.1 | 100 | 0 | 100 | 12.7 |
| 74 | 63 | Absent | 65 | 6 | 1 | 0.4 | 100 | 0 | 100 | 13.0 |
| 75 | 64 | Absent | 58 | 5 | 1 | 0.3 | 100 | 0 | 100 | 4.7 |

| | Hot-stamping formed body | | | Mechanical properties | | | | |
|---|---|---|---|---|---|---|---|---|
| Test No. | Average Mn concentration of prior γ grain boundaries (mass %) | Density of carbides having circle equivalent diameter of 0.20 μm or more (/μm²) | Partially softened region | Tensile strength (MPa) | Average hardness (Hv) | Early fracture evaluation | Hardness variation ΔHv (Hv) | Note |
| 51 | 0.3 | 0.1 | Absent | 2,359 | 737 | 0.97 | 20 | Invention Example |
| 52 | 0.3 | 0.1 | Absent | 2,320 | 740 | 0.95 | 24 | Invention Example |
| 53 | 0.4 | 0.1 | Absent | 2,332 | 736 | 0.96 | 27 | Invention Example |
| 54 | 0.3 | 0.1 | Absent | 2,372 | 741 | 0.97 | 22 | Invention Example |
| 55 | 0.3 | 0.1 | Present | 2,326 | 742 | 0.95 | 16 | Invention Example |
| 56 | 0.3 | 0 | Absent | 2,332 | 744 | 0.95 | 15 | Invention Example |
| 57 | 0.3 | 0 | Absent | 2,323 | 749 | 0.94 | 18 | Invention Example |

TABLE 11-continued

| | | | | | | | | |
|---|---|---|---|---|---|---|---|---|
| 58 | 0.3 | 0.1 | Absent | 2,421 | 741 | 0.99 | 15 | Invention Example |
| 59 | 0.4 | 0.2 | Absent | 2,314 | 738 | 0.95 | 24 | Invention Example |
| 60 | 0.3 | 0.1 | Absent | 2,388 | 746 | 0.97 | 26 | Invention Example |
| 61 | 0.4 | 0 | Absent | 2,383 | 737 | 0.98 | 25 | Invention Example |
| 62 | 0.4 | 0.1 | Absent | 2,292 | 739 | 0.94 | 19 | Invention Example |
| 63 | 1.6 | 0.4 | Absent | 1,290 | 674 | 0.58 | 51 | Comparative Example |
| 64 | 1.2 | 0.1 | Absent | 618 | 720 | 0.26 | 52 | Comparative Example |
| 65 | 1.5 | 0.3 | Absent | 700 | 731 | 0.29 | 53 | Comparative Example |
| 66 | — | — | Absent | — | — | — | — | Comparative Example |
| 67 | 1.6 | 0.1 | Absent | 1,244 | 711 | 0.53 | 51 | Comparative Example |
| 68 | 1.7 | 0.8 | Absent | 582 | 705 | 0.25 | 52 | Comparative Example |
| 69 | 1.6 | 0.1 | Absent | 639 | 717 | 0.27 | 54 | Comparative Example |
| 70 | 1.0 | 0.1 | Absent | 689 | 720 | 0.29 | 48 | Comparative Example |
| 71 | 1.0 | 0.2 | Absent | 1,329 | 732 | 0.55 | 46 | Comparative Example |
| 72 | 1.3 | 0.2 | Absent | 1,436 | 750 | 0.58 | 55 | Comparative Example |
| 73 | 1.0 | 0.1 | Absent | 714 | 698 | 0.31 | 42 | Comparative Example |
| 74 | 0.3 | 0 | Absent | 2,044 | 1050 | 0.59 | 50 | Comparative Example |
| 75 | 0.8 | 0.1 | Absent | 1,863 | 576 | 0.98 | 36 | Comparative Example |

Underline means outside the range specified in the present invention or that the target performance is not satisfied.

TABLE 12

| | | Steel sheet for hot stamping | | | | | Hot-stamping formed body | | | |
|---|---|---|---|---|---|---|---|---|---|---|
| | | | Proportion of high angle grain boundaries (%) | Microstructure: Residual austenite (area %) | Microstructure: Others (area %) | Density of carbides having circle equivalent diameter of 0.20 μm or more (/μm$^2$) | Microstructure: Martensite (area %) | Microstructure: Others (area %) | Microstructure: Total (area %) | Average grain size of prior γ (μm) |
| Test No. | Steel No. | Plating | | | | | | | | |
| 76 | 65 | Absent | 49 | 4 | 0 | 0.1 | 100 | 0 | 100 | 2.3 |
| 77 | 66 | Absent | 50 | 4 | 0 | 0.1 | 100 | 0 | 100 | 2.1 |
| 78 | 67 | Absent | 46 | 5 | 0 | 0.1 | 100 | 0 | 100 | 3.0 |
| 79 | 68 | Absent | 48 | 6 | 0 | 0.2 | 100 | 0 | 100 | 3.0 |
| 80 | 69 | Absent | 49 | 4 | 0 | 0.2 | 100 | 0 | 100 | 2.9 |
| 81 | 70 | Absent | 47 | 6 | 0 | 0.2 | 100 | 0 | 100 | 2.2 |
| 82 | 70 | Absent | 50 | 0 | 0 | 0.1 | 100 | 0 | 100 | 3.1 |
| 83 | 45 | Absent | 52 | 0 | 0 | 0.1 | 100 | 0 | 100 | 3.3 |
| 84 | 40 | Absent | 53 | 0 | 0 | 0.1 | 100 | 0 | 100 | 3.5 |
| 85 | 70 | Absent | 41 | 5 | 1 | 0.3 | 100 | 0 | 100 | 3.4 |
| 86 | 45 | Absent | 42 | 3 | 2 | 0.1 | 100 | 0 | 100 | 3.6 |
| 87 | 65 | Absent | 47 | 6 | 0 | 0.1 | 100 | 0 | 100 | 2.2 |
| 88 | 65 | Absent | 45 | 7 | 0 | 0.1 | 100 | 0 | 100 | 2.1 |
| 89 | 21 | Absent | 42 | 4 | 0 | 0.1 | 100 | 0 | 100 | 3.9 |
| 90 | 5 | Absent | 41 | 3 | 0 | 0.4 | 100 | 0 | 100 | 4.5 |
| 91 | 16 | Absent | 48 | 4 | 0 | 0.2 | 100 | 0 | 100 | 4.9 |
| 92 | 44 | Absent | 46 | 1 | 0 | 0.1 | 100 | 0 | 100 | 5.5 |
| 93 | 44 | Absent | 45 | 1 | 0 | 0.1 | 100 | 0 | 100 | 5.7 |
| 94 | 44 | Absent | 46 | 1 | 0 | 0.1 | 100 | 0 | 100 | 3.2 |
| 95 | 40 | Absent | 46 | 3 | 0 | 0.1 | 100 | 0 | 100 | 2.5 |
| 96 | 2 | Absent | 48 | 5 | 0 | 0 | 100 | 0 | 100 | 4.6 |
| 97 | 5 | Absent | 41 | 3 | 0 | 0.3 | 100 | 0 | 100 | 3.4 |
| 98 | 7 | Absent | 55 | 5 | 1 | 0.4 | 100 | 0 | 100 | 5.5 |
| 99 | 24 | Absent | 44 | 1 | 1 | 0.2 | 100 | 0 | 100 | 5.6 |
| 100 | 47 | Absent | 44 | 1 | 0 | 0.2 | 100 | 0 | 100 | 5.3 |

TABLE 12-continued

| | Hot-stamping formed body | | | Mechanical properties | | | | |
|---|---|---|---|---|---|---|---|---|
| Test No. | Average Mn concentration of prior γ grain boundaries (mass %) | Density of carbides having circle equivalent diameter of 0.20 μm or more (/μm²) | Partially softened region | Tensile strength (MPa) | Average hardness (Hv) | Early fracture evaluation | Hardness variation ΔHv (Hv) | Note |
| 76 | 0.3 | 0.1 | Absent | 2,426 | 750 | 0.98 | 19 | Invention Example |
| 77 | 0.3 | 0.1 | Absent | 2,422 | 749 | 0.98 | 20 | Invention Example |
| 78 | 0.4 | 0.1 | Absent | 2,347 | 741 | 0.96 | 24 | Invention Example |
| 79 | 0.5 | 0.1 | Absent | 2,353 | 735 | 0.97 | 25 | Invention Example |
| 80 | 0.6 | 0.1 | Absent | 2,386 | 753 | 0.96 | 27 | Invention Example |
| 81 | 0.4 | 0.1 | Absent | 2,367 | 755 | 0.95 | 23 | Invention Example |
| 82 | 1.1 | 0.1 | Absent | 1,482 | 761 | 0.59 | 54 | Comparative Example |
| 83 | 1.3 | 0 | Absent | 1,186 | 719 | 0.50 | 52 | Comparative Example |
| 84 | 1.2 | 0 | Absent | 1,220 | 711 | 0.52 | 51 | Comparative Example |
| 85 | 1.1 | 0.1 | Absent | 1,428 | 746 | 0.58 | 53 | Comparative Example |
| 86 | 1.4 | 0 | Absent | 1,065 | 717 | 0.45 | 51 | Comparative Example |
| 87 | 0.3 | 0 | Absent | 2,457 | 752 | 0.99 | 17 | Invention Example |
| 88 | 0.2 | 0.1 | Absent | 2,485 | 753 | 1.00 | 14 | Invention Example |
| 89 | 0.1 | 0.2 | Absent | 2,375 | 727 | 0.99 | 12 | Invention Example |
| 90 | 1.2 | 0.2 | Absent | 1,179 | 674 | 0.53 | 51 | Comparative Example |
| 91 | 1.3 | 0.1 | Present | 1,195 | 739 | 0.49 | 53 | Comparative Example |
| 92 | 1.1 | 0.2 | Absent | 1,343 | 740 | 0.55 | 52 | Comparative Example |
| 93 | 1.1 | 0.2 | Absent | 1,364 | 738 | 0.56 | 52 | Comparative Example |
| 94 | 1.1 | 0.1 | Absent | 1,430 | 747 | 0.58 | 51 | Comparative Example |
| 95 | 1.2 | 0.3 | Absent | 1,234 | 733 | 0.51 | 52 | Comparative Example |
| 96 | 1.5 | 0.4 | Absent | 1,004 | 676 | 0.45 | 54 | Comparative Example |
| 97 | 1.1 | 0.1 | Absent | 1,277 | 679 | 0.57 | 51 | Comparative Example |
| 98 | 0.3 | 0.2 | Absent | 1,552 | 960 | 0.49 | 48 | Comparative Example |
| 99 | 0.5 | 0.2 | Absent | 1,315 | 699 | 0.57 | 21 | Comparative Example |
| 100 | 0.4 | 0.1 | Absent | 1,437 | 738 | 0.59 | 24 | Comparative Example |

Underline means outside the range specified in the present invention or that the target performance is not satisfied.

TABLE 13

| | | Steel sheet for hot stamping | | | | | Hot-stamping formed body | | | |
|---|---|---|---|---|---|---|---|---|---|---|
| | | | Proportion of high angle grain boundaries | Microstructure | | Density of carbides having circle equivalent diameter of 0.20 μm or more | Microstructure | | | Average grain size |
| Test No. | Steel No. | Plating | (%) | Residual austenite (area %) | Others (area %) | (/μm²) | Martensite (area %) | Others (area %) | Total (area %) | of prior γ (μm) |
| 101 | 5 | Absent | 40 | 3 | 0 | 0.2 | 100 | 0 | 100 | 7.8 |
| 102 | 66 | Absent | 50 | 4 | 0 | 0.1 | 100 | 0 | 100 | 1.9 |
| 103 | 44 | Absent | 41 | 4 | 0 | 0.1 | 100 | 0 | 100 | 3.1 |
| 104 | 16 | Absent | 48 | 5 | 0 | 0.2 | 100 | 0 | 100 | 3.0 |
| 105 | 53 | Absent | 42 | 6 | 0 | 0.1 | 100 | 0 | 100 | 4.0 |
| 106 | 10 | Present | 46 | 3 | 1 | 0.3 | 100 | 0 | 100 | 4.5 |
| 107 | 21 | Absent | 44 | 3 | 0 | 0.2 | 100 | 0 | 100 | 4.7 |
| 108 | 68 | Absent | 48 | 5 | 0 | 0.1 | 100 | 0 | 100 | 3.9 |
| 109 | 44 | Absent | 42 | 1 | 0 | 0.2 | 100 | 0 | 100 | 3.1 |
| 110 | 69 | Absent | 49 | 4 | 0 | 0.2 | 100 | 0 | 100 | 2.6 |
| 111 | 44 | Absent | 42 | 1 | 0 | 0.2 | 100 | 0 | 100 | 4.9 |
| 112 | 71 | Absent | 49 | 9 | 0 | 0.1 | 100 | 0 | 100 | 2.2 |
| 113 | 71 | Absent | 60 | 0 | 1 | 0.6 | 100 | 0 | 100 | 4.5 |
| 114 | 71 | Absent | 59 | 0 | 1 | 0.1 | 100 | 0 | 100 | 5.3 |
| 115 | 71 | Absent | 58 | 1 | 1 | 0.1 | 100 | 0 | 100 | 5.0 |
| 116 | 71 | Absent | 58 | 1 | 1 | 0.1 | 100 | 0 | 100 | 5.6 |

TABLE 13-continued

| Test No. | Hot-stamping formed body: Average Mn concentration of prior γ grain boundaries (mass %) | Density of carbides having circle equivalent diameter of 0.20 μm or more (/μm²) | Partially softened region | Mechanical properties: Tensile strength (MPa) | Average hardness (Hv) | Early fracture evaluation | Hardness variation ΔHv (Hv) | Note |
|---|---|---|---|---|---|---|---|---|
| 101 | 0.9 | 0.1 | Absent | 1,308 | 672 | 0.59 | 40 | Comparative Example |
| 102 | 0.2 | 0.1 | Absent | 2,478 | 751 | 1.00 | 15 | Invention Example |
| 103 | 0.7 | 0.2 | Absent | 2,363 | 746 | 0.96 | 30 | Invention Example |
| 104 | 0.6 | 0.1 | Present | 2,391 | 747 | 0.97 | 28 | Invention Example |
| 105 | 0.3 | 0.1 | Absent | 2,439 | 739 | 1.00 | 18 | Invention Example |
| 106 | 0.5 | 0.2 | Absent | 2,377 | 735 | 0.98 | 23 | Invention Example |
| 107 | 0.3 | 0.2 | Absent | 2,328 | 720 | 0.98 | 20 | Invention Example |
| 108 | 0.4 | 0.1 | Absent | 2,395 | 733 | 0.99 | 24 | Invention Example |
| 109 | 0.9 | 0.2 | Absent | 2,142 | 746 | 0.87 | 41 | Invention Example |
| 110 | 0.7 | 0.1 | Absent | 2,358 | 752 | 0.95 | 36 | Invention Example |
| 111 | 0.9 | 0.1 | Absent | 2,122 | 739 | 0.87 | 39 | Invention Example |
| 112 | 0.2 | 0.1 | Absent | 2,475 | 750 | 1.00 | 13 | Comparative Example |
| 113 | 1.1 | 0.3 | Absent | 2,591 | 785 | 1.00 | 60 | Comparative Example |
| 114 | 1.2 | 0.4 | Absent | 2,496 | 764 | 0.99 | 57 | Comparative Example |
| 115 | 1.1 | 0.4 | Absent | 2,493 | 771 | 0.98 | 62 | Comparative Example |
| 116 | 1.2 | 0.4 | Absent | 2,433 | 760 | 0.97 | 55 | Comparative Example |

Underline means outside the range specified in the present invention or that the target performance is not satisfied.

As shown in Tables 1 to 13, the invention examples satisfying the chemical composition and microstructure specified in the present invention were excellent in mechanical properties. The comparative examples that did not satisfy the chemical composition and microstructure specified in the present invention were inferior in mechanical properties.

INDUSTRIAL APPLICABILITY

According to the above aspect according to the present invention, it is possible to provide a hot-stamping formed body having excellent strength and toughness.

The invention claimed is:

1. A hot-stamping formed body comprising, as a chemical composition, by mass %:

C: 0.40% to 0.70%;
Si: 0.010% to 1.30%;
Mn: 0.40% to 3.00%;
sol. Al: 0.0010% to 0.500%;
Ti: 0.010% to 0.100%;
Cr: 0.010% to 0.80%;
B: 0.0005% to 0.0100%;
P: 0.100% or less;
S: 0.0100% or less;
N: 0.0100% or less;
Nb: 0% to 0.100%;
Mo: 0% to 1.00%;
V: 0% to 0.100%;
Ni: 0% to 0.50%;
REM: 0% to 0.0100%;
Mg: 0% to 0.0100%;
Ca: 0% to 0.0100%;
Co: 0% to 4.00%; and
a remainder consisting of Fe and impurities,
wherein an average grain size of prior austenite grains in a microstructure is 5.0 μm or less, and
an average Mn concentration at grain boundaries of the prior austenite grains is 1.0 mass % or less.

2. A hot-stamping formed body comprising, as a chemical composition, by mass %:

C: 0.40% to 0.70%;
Si: 0.010% to 1.30%;
Mn: 0.40% to 3.00%;
sol. Al: 0.0010% to 0.500%;
Ti: 0.010% to 0.100%;
Cr: 0.010% to 0.80%;
B: 0.0005% to 0.0100%;
P: 0.100% or less;
S: 0.0100% or less;
N: 0.0100% or less;
Nb: 0% to 0.100%;
Mo: 0% to 1.00%;
V: 0% to 0.100%;
Ni: 0% to 0.50%;
REM: 0% to 0.0100%;
Mg: 0% to 0.0100%;
Ca: 0% to 0.0100%;
Co: 0% to 4.00%; and
a remainder comprising Fe and impurities,
wherein an average grain size of prior austenite grains in a microstructure is 5.0 μm or less, and
an average Mn concentration at grain boundaries of the prior austenite grains is 1.0 mass % or less.

3. The hot-stamping formed body according to claim 1 comprising, as the chemical composition, by mass %, one or more elements selected from:

Nb: 0.010% to 0.100%;
Mo: 0.01% to 1.00%;
V: 0.001% to 0.100%;
Ni: 0.001% to 0.50%;
REM: 0.0010% to 0.0100%;
Mg: 0.0010% to 0.0100%;
Ca: 0.0010% to 0.0100%; and
Co: 0.10% to 4.00%.

4. The hot-stamping formed body according to claim 1, further comprising:

a plating layer on a surface of the hot-stamping formed body.

5. The hot-stamping formed body according to claim 1, wherein a portion of the hot-stamping formed body has a softened region.

6. The hot-stamping formed body according to claim 3, further comprising:

a plating layer on a surface of the hot-stamping formed body.

7. The hot-stamping formed body according to claim 3, wherein a portion of the hot-stamping formed body has a softened region.

8. The hot-stamping formed body according to claim 4, wherein a portion of the hot-stamping formed body has a softened region.

* * * * *